US006725515B2

(12) United States Patent
Lotz

(10) Patent No.: US 6,725,515 B2
(45) Date of Patent: Apr. 27, 2004

(54) MECHANICAL SCARFING DEBURRER FOR THE ELIMINATION OF OXYGEN CUTTING BURRS AND OXYGEN CUTTING BEADS AFTER THE THERMOCHEMICAL TRANSVERSE OR LONGITUDINAL DIVIDING OF STEEL WORKPIECES LIKE SLABS, BLOOMS AND BILLETS

(75) Inventor: Horst Karl Lotz, Hofheim-Wallau (DE)

(73) Assignee: Gega Corporation, Pittsburgh, PA (US)

( * ) Notice: Subject to any disclaimer, the term of this patent is extended or adjusted under 35 U.S.C. 154(b) by 0 days.

(21) Appl. No.: 09/900,661

(22) Filed: Jul. 6, 2001

(65) Prior Publication Data

US 2002/0025234 A1 Feb. 28, 2002

(30) Foreign Application Priority Data

Jul. 15, 2000 (EP) ..... 00115360

(51) Int. Cl.[7] ..... B23P 23/04

(52) U.S. Cl. ..... 29/33 A; 409/138; 409/140; 409/297

(58) Field of Search ..... 29/33 A; 409/297–300, 409/138, 140

(56) References Cited

U.S. PATENT DOCUMENTS 3,672,017 A * 6/1972 Nielsen et al. ..... 407/49
3,861,011 A * 1/1975 Nose et al. ..... 407/11
3,940,214 A * 2/1976 Waschek ..... 408/26
4,219,292 A * 8/1980 Hoffmann et al. ..... 407/63
4,227,837 A * 10/1980 Yodoshi ..... 407/53
4,480,949 A * 11/1984 Van De Bogart ..... 407/54
4,632,365 A * 12/1986 Peddinghaus ..... 266/48
5,542,793 A * 8/1996 Deiss et al. ..... 407/35
5,586,843 A * 12/1996 Minicozzi ..... 407/42

FOREIGN PATENT DOCUMENTS

DE 3521784 * 1/1987 ..... 29/33 A
JP 6-262432 * 9/1994 ..... 29/33 A
JP 7-24633 * 1/1995 ..... 29/33 A
JP 6-297341 * 10/1995 ..... 29/33 A

* cited by examiner

*Primary Examiner*—Daniel W. Howell
*Assistant Examiner*—Dana Ross
(74) *Attorney, Agent, or Firm*—Brij K. Argarwal; Eckert Seamans Cherin & Mellott, LLC

(57) ABSTRACT

Using machines, equipment and devices for mechanical scarfing off of oxygen cutting burr from workpieces of steel, the deburring will be safer with a better deburring ratio, lower cost and with better, advantageous maintenance and wear part situations. The scarfing process performs even if limited, step by step continuously, following in every height level of the cutting oxygen burr with a tool continuously moving from down to up with a suitable adjustment.

18 Claims, 29 Drawing Sheets

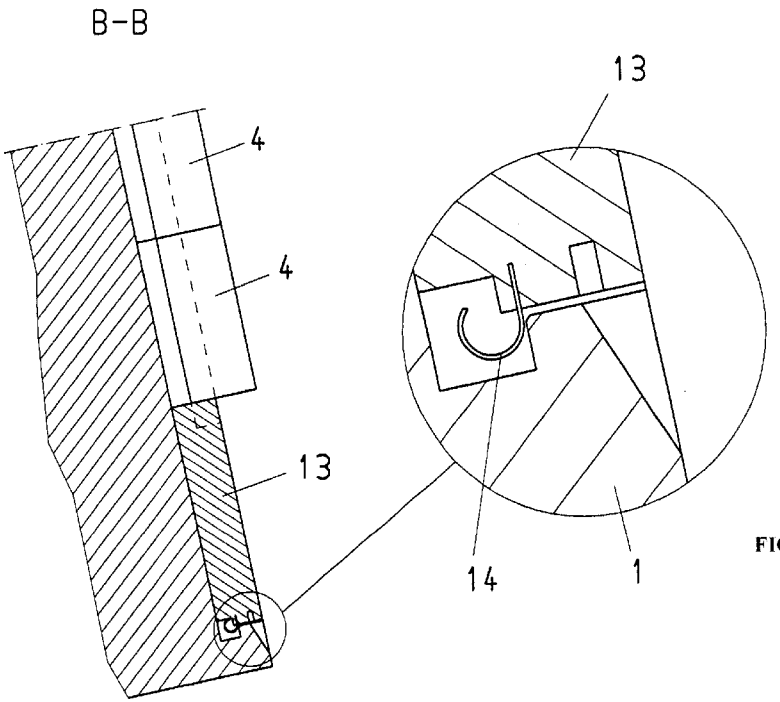
FIG. 24
FIG. 26
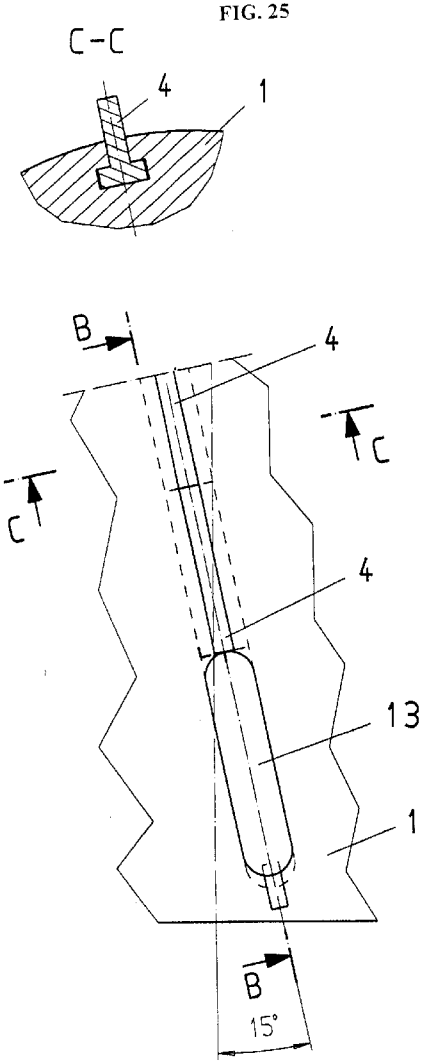
FIG. 25
FIG. 23

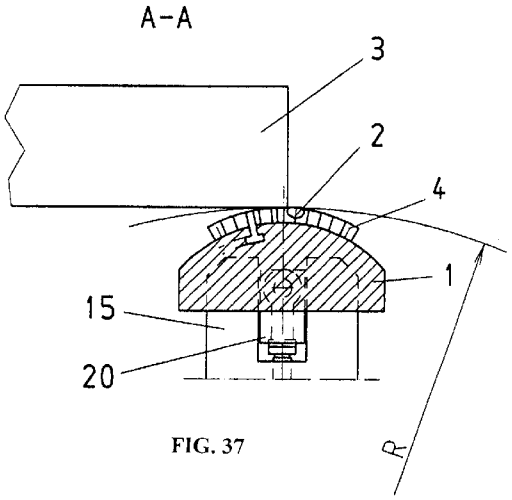
FIG. 37
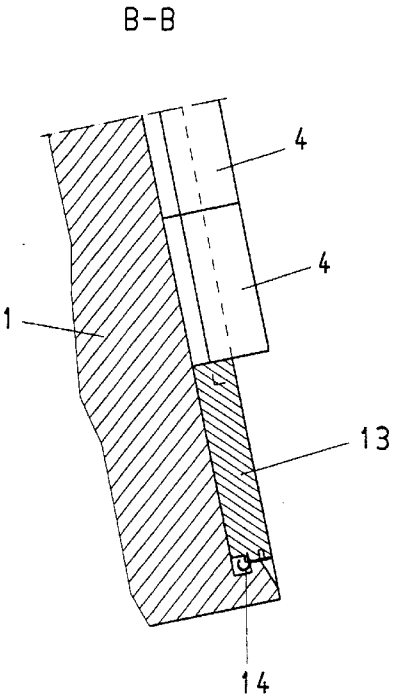
FIG. 39
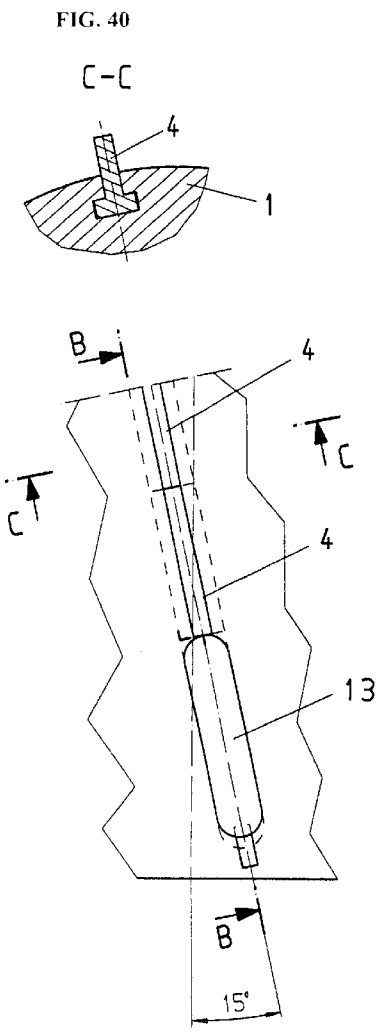
FIG. 40
FIG. 38

MECHANICAL SCARFING DEBURRER FOR THE ELIMINATION OF OXYGEN CUTTING BURRS AND OXYGEN CUTTING BEADS AFTER THE THERMOCHEMICAL TRANSVERSE OR LONGITUDINAL DIVIDING OF STEEL WORKPIECES LIKE SLABS, BLOOMS AND BILLETS

BACKGROUND OF THE INVENTION

1. Field of the Invention

The present invention relates generally to metalworking apparatuses and, more particularly, to deburring machines.

2. Description of the Related Art

In connection with the worldwide increase of continuous steel casting plants, the predominant use of oxygen cutting for subdividing or longitudinal dividing and the rationalization respectively improvement of existing plants, the mechanized or even automated deburring or debeading, i.e., the elimination of the oxygen cutting burr normally on the lower edges of slabs, blooms and billets or the elimination of oxygen cutting beads on the top edges of the same, if possible right after the oxy-cutting longitudinal or cross dividing is increasing in importance. Especially cost advantageous, safe, easy to maintain and easy to implant deburrers with a high deburring rate are indispensable for the high production of modern plants.

Meanwhile there are a big number of well working deburrers, but the cost, the deburring rates, the expense for maintenance, good installation positions (in the production line) and before all the danger of injury and high noise level leave much to be desired.

With all known designs in successful operations so far, the following deburring principles with the appertaining main elements the meanwhile complained deficiencies and disadvantages apply.

Deburring Principles:

The workpieces are lying stationary with their front or end oxygen cutting burr above the deburrer for deburring out of the workpiece and are deburred by being pushed by means of a roller table, pinch rollers or pushing drives.

The workpieces are lying stationary with their front or end oxygen cutting burr above the deburrer for deburring out of the workpiece and are deburred by shifting the deburrer or by rotation of its drum against the fixed workpiece.

The workpieces are moved on a roller table with working or transport speed, the front and the end oxygen cutting burr are knocked off from out of the workpiece by overtaking or counter rotation of a deburrer rotor.

For this the stationary or shifting deburrers of the first three systems are equipped with straight, horizontal scarfing bars or with side by side arranged, maybe as well with elastically lifting or lowering, squared or round shearing blocks.

The deburrers of the fourth system use for deburring little hammers fixed with movable joints distributed along and around a rotor, which stand up by centrifugal force at high numbers of rotation and thus knock off the oxygen cutting burr passing above into many small pieces.

A as far as well successful design of a deburrer differing further away from the above systems is a machine traveling with a feed speed longitudinally with the oxygen cutting burr, which presses a plate like shearing tool on a lever against the lower workpiece surface from below and knocks off or shears off the oxygen cutting burr by a pendulum type swinging to and of the lever horizontally. This design, predominantly used on stationary resting workpieces, can be used because of its limited size of the shearing tool only for limited production, and at that only under limited circumstances such as much time requirement, big space requirement and extreme installation cost.

The three at the present stage most successful deburrers are described in short as follows:

A stationary or shifting deburrer with a piston body out of which adjacent arranged, compressed air propelled pistons shift upward the shear caps which they carry and press them against the lower surface of the workpiece and shear off or push off the cutting oxygen burr relative to its material composition and temperature, when the deburrer or the workpiece are shifting. The main disadvantage of this deburrer is its limited or only complicated use for continuously moving workpieces, its many moving parts and the at times low deburring rate (below 99%), i.e., little rests of the cutting oxygen burr stay at the workpiece or they are only flipped up. As well little pieces of the cutting oxygen burr can stick between neighboring pistons and shear caps and reduce the efficiency of the deburrer very much. This well reduces the deburring rate. Accessibility, safety, availability and low operation noise belong to the advantages of this deburrer.

Stationary and with an exactly above it positioned workpiece works a drum deburrer or respectively rotation deburrer, on the drum of which ring-shaped or round but as well springingly shearing tools could be found adjacently side by side and distributed on the circumference. The drum is lifted hydraulically and rotated slowly, whereby the cutting oxygen burr exactly above is sheared or pushed off. The robust and powerful operation of this deburrer ensure safe working as well with bigger cutting oxygen burrs, but noise and time requirement (stand still and positioning) as well as bad deburring rates together with the high expenses are the disadvantages of this deburrer.

A tilting deburrer with straight all over shearing strips on front and end is the most simple and lowest cost design of a deburrer. Although at a particular tilting a shearing strip is pressed sincerely against the lower surface of the workpiece, the bad deburring rate at side way inclined, convex or concave lower surface and the indispensable forward/backward traveling of the workpiece are the unacceptably big disadvantages of this deburrer, even if the deburring forces and the working noise are kept low by an inclined, evenly, increasing by attaching shearing strip.

The without doubt most positive deburrer for a time independent, fast deburring of workpiece passing without stop, with the smallest space requirement in a roller table gap i.e., following a continuous casting plant is the rotation deburrer with a quickly rotating rotor equipped with hammers.

Of course power requirement and plant cost are very high, but inclined position of the workpiece, convex and concave lower surfaces and differences of moving speeds are no problems for this deburrer within limits, even if the distance to the lower surfaces is given with a tight tolerance.

But other problems are imminent instead. As the oxygen cutting beard is broken through by the many small hammers often and unevenly with high forces and great speeds a very great noise develops. The wear is disproportionately high and often the hammers are destroyed and more often burr pieces are flipped up and subsequently not eliminated.

The amount of maintenance is extremely high due to the exchange or replacement of the little hammers and the necessary disassembly of protection panels, especially since the latter must be fastened very carefully because of the burr pieces flying away with high energy. Otherwise bad injuries or damages are caused by metal pieces flying further away.

Much less noise and more safety has a deburrer which operates with slower, i.e., with roller table speed at maximum. For this a beam-like piston body, arranged below the workpiece and equipped with compressed air actuated deburring pistons, is shifted for deburring against the stationary or slowly moving oxygen cutting burr after being pressed against the lower surface for deburring to well the workpiece can be pushed with its oxygen cutting burr against the stationary deburrer and this happens twice per workpiece at each end out of the workpiece toward the respective end and further on. This way no metal pieces flying around dangerously, as well if no complicated protection cover is necessary, but the workpiece has to be traveled to and from, wasting time. and space. But with this design parts of the oxygen cutting burr are flipped up as well.

SUMMARY OF THE INVENTION

A mechanical scarfing deburrer for the elimination of oxygen cutting burrs and oxygen cutting beads after the thermochemical transversal or longitudinal dividing of steel workpieces like slabs, blooms and billets in hot or cold condition, stationary or moving on a roller table, can be generally stated as including a horizontally arranged deburrer drum or a deburrer drum segment supported on its horizontal axle stubs, or a deburrer plate slightly inclined against the horizontal plane and supported by is shaft slightly inclined to a vertical axis, rotating by means of an electric motor or hydraulic drive or driven by the moving workpiece via a drive lever and gear box, of which the bearings, the scarfing knifes holder, or the scarfing knifes themselves can be lifted in a spring buffer fashion, and of which the shell of the deburrer drum or of the deburrer drum segment has fully or partly surrounding scarfing knife spirals or of which the deburrer plate has on its surface spoke-like or eccentric spokes, rectangular or parallelogram arranged or scarfing knife strips, as well arranged as rectangular or parallelogram-like scarfing blocks or also round scarfing blades, whereby the scarfing knifes or scarfing blocks attack the oxygen cutting burr with an angle of approximately 10° to 80° to the latter and can scarf it off continuously or piece after piece. Accordingly the round scarfing block will only be applied with the quarter adjacent to the oxygen cutting burr to be scarfed off when scarfing the latter out of the lower surface of the workpiece.

A special notching wheel device is arranged close by or near the scarfing deburrer to notch cutting burrs consisting of tough material and rotates in a tilting notching lever supported underneath the cutting burr and consist of one or more step wheels beside a multi-edge chisel wheel which carry the latter and are rotated by friction of the workpiece or a special drive.

The notching lever rests with its step wheel end on a piston of a compressed air cylinder, which will be pressed down when rotating the step wheel and jumps up when passing the step.

In a disk roller table in between the disks, sleeves are clamped on, which deform the oxygen cutting burr to a maximum of 3 mm heights against the lower surface of the workpiece for better notching before deburring. The sleeves in conical design as well push over higher oxygen cutting burr of more than 10 mm on the one side, improve thus the notching and the interruption of the whole oxygen cutting burr for deburring. The sleeves can as well be equipped with chisel edges for direct notching of the oxygen cutting burr.

To scratch off smaller rests of the oxygen cutting burr flipped up by the deburrer, a spring scratcher device is applied, which consists of a flat spring or a spiral spring, a spring support and scratchers and can give way against the scratch direction or a rectangular angle or any similar.

A mechanical scarfing deburrer can additionally be characterized by the scarfing knifes winding around the deburrer drum fully or partly, once or several times, having even constant or uneven irregular distances between them in a way that the oxygen burr can enter in total width or length into the deburrer drum or into the deburrer plate without touching the scarfing knifes or the scarfing spokes and that these then could scarf the oxygen cutting burr overtaking or moving in opposite direction. The scarfing knife spirals could as well be arranged in opposite directions, i.e., crossing each other once or several times winding around the drum.

A mechanical scarfing deburrer can additionally be characterized by a so-called separating chisel similar to a piece of scarfing knife being arranged at the end of a scarfing knife spiral or scarfing knife spoke with an angle of 90° to 150° in order to subdivide the cut oxygen cutting burr before a complete scarfing.

A mechanical scarfing deburrer can additionally be characterized by the scarfing knife spirals or the scarfing knife spokes consisting of scarfing knife pieces which are pushed into swallow tail or T-grooves in the deburrer drum shell or into the surface of the deburring plate and which are 20 to 500 mm. long and showing a cross section like an inverted T or like a trapezoid or a combination of both. They are bent or twist over their length.

A mechanical deburrer can additionally be characterized by including a round scarfing block equipped with a chisel like horizontal edge in the round section for contacting the lower surface of the workpiece, above which in a short distance the scarfing block is formed as a multi-edge with vertical edges.

A mechanical deburrer can additionally be characterized by a round scarfing block being only working with one quarter of its round edge to produce the scarfing effect, because of the speed relations of the workpiece respectively the oxygen cutting burr passing speed to the deburrer plate rotating speed in the scarfing block area.

A mechanical deburrer can additionally be characterized by a deburring scarfing speed which is the difference between the necessary moving speed of the scarfing knife spiral or of the scarfing knife spokes and the specific moving speed of the oxygen cutting burr on slab, bloom or billet, i.e. between 3 to 150 m/min. This difference is as small as possible, namely only two to five times the moving speed of the oxygen cutting burr or the oxygen cutting beads to avoid noise and dangerously flying parts of burr, beads and tools.

A mechanical scarfing deburrer can additionally be characterized by the deburrer drum resting in two independently heights adjustable bearing blocks, which allows to equalize various inclinations of the scarfing deburrer drum at the lower surface of the workpiece, angled positions as well as height positions, with the bearing blocks being rotatable.

These height adjustable bearing blocks, at least one, are resting on spring-like pneumatic lifting cylinders, which lift the scarfing deburrer drum against the surface of slab, bloom and billet and press it on near to the oxygen cutting burr, and this right before or during the scarfing deburrer drum rotation.

A mechanical scarfing deburrer can additionally be characterized by a deburring lever bearing a deburrer drum segment with a deburrer knife spiral at its upper end, standing slightly inclined to the vertical axis below the workpiece in a bearing and being linked via a reduction gear with a driving lever on the same axle, which protrudes vertically into a roller table gap and has a rotatably supported roller at the level of the workpiece for pushing, shifting and down pressing of the driving lever. Thereby the oxygen cutting burr at the workpiece front edge is scarfed off.

In the same bearing block a second driving lever with a pulling load is arranged horizontally lying in front of the driving lever and is solidly connected with an equally rotating, inclined in front and above it arranged deburring lever and its scarfing knife spiral. Between the driving levers a spring pulling element is provided, which allows a horizontal position of the driving lever at a vertical position of the driving lever by the help of a pulling weight on the driving lever 1. Thus the driving lever can be pulled with its deburring lever underneath the workpiece, where it rolls along towards the end of the workpiece until it jumps up pulled by the spring and presents the deburrer lever and its scarfing knife spiral before the end burr and this is scarfed off using the energy of the onward. moving workpiece.

A mechanical scarfing deburrer can additionally be characterized by the scarfing knife or a part of it resting on at least two points if not over its total length on springs and balancing thus heights differences and inclined positions of the lower surface of the workpiece.

A mechanical scarfing deburrer can additionally be characterized by the fact that the axle stubs of the deburrer drum segment are arranged flattened and height adjustable in the segment levers corresponding to the front surface of the deburrer drum and sit on lifting cylinders for pressing against the lower workpiece surface.

A mechanical scarfing deburrer can additionally be characterized by a scarfing deburrer plate resting on axial and radial acting bearing blocks of which the supporting frame is sitting in a spring like fashion on pneumatic lifting cylinders, which can lift and press the scarfing deburrer plate with its rectangular, parallelogram-shaped or round scarfing blocks against the surface of the workpiece to be deburred near the oxygen cutting burr just before or while the scarfing deburrer plate is rotating.

A mechanical scarfing deburrer can additionally be characterized by a notching chisel for notching and therefore for piecewise scarfing off of an otherwise with soft material undetermined long scarfed-off oxygen cutting burr and that this notching chisel is supported in its middle and having anvil disks on a solid notching lever supported by a knocking cylinder underneath the traveling workpiece, until a sudden thrust of the knocking cylinder makes the notching lever and the notching edge thrust up.

The notching chisel has one or two anvil disks beside its edge which serve to avoid a notching into the lower surface of the workpiece beside the oxygen cutting burr. The anvil disks can be designed in a spiral shape with a sudden step, which rotate by friction and compress a compressed air cylinder or a spring by its spiral shape, which jump up when passing the step and effect a notching thrust at regular distances.

A mechanical scarfing deburrer can additionally be characterized by a burr scratcher which is applied to scratch off rests of oxygen cutting burr after deburring, pressed onto the workpiece in a spring-like fashion. The scratcher has a scratcher blade made of a spring blade bent forward in scratching direction on its end and bent backwards otherwise and consist of an inclined scratching block and a clamping pad with clamping bolts. The end of the scratcher blade serving as scratcher edge is hardened or reinforced with hard and wear respectively heat resistant edges and show from down to up in scratching direction by the inclination of the scratcher block.

BRIEF DESCRIPTION OF THE DRAWINGS

A further understanding of the invention can be gained from the following description of the preferred embodiment when read in conjunction with the accompanying drawings in which:

FIG. 23 is an enlarged view of FIG. 17;

FIG. 24 is an enlarged view of FIG. 18;

FIG. 25 is an enlarged view of FIG. 19;

FIG. 26 is an enlarged view of the encircled portion of FIG. 24;

FIG. 37 is an enlarged view of FIG. 30;

FIG. 38 is an enlarged view of FIG. 31;

FIG. 39 is an enlarged view of FIG. 32;

FIG. 40 is an enlarged view of FIG. 33;

DESCRIPTION OF THE PREFERRED EMBODIMENT

Figure 3:
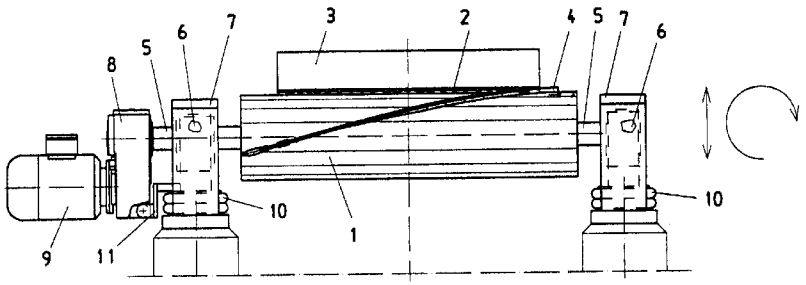
FIG. 3 is a side elevational view of the first embodiment.
Figure 2:
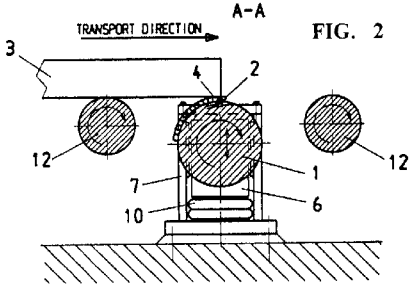
FIG. 2 is a sectional view as taken along line A—A of FIG. 1.
Figure 5:
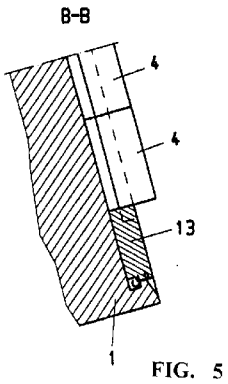
FIG. 5 is a sectional view as taken along line B—B of FIG. 4.
Figure 6:
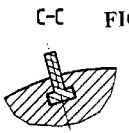
FIG. 6 is a sectional view as taken along line C—C of FIG. 4.
Figure 4:
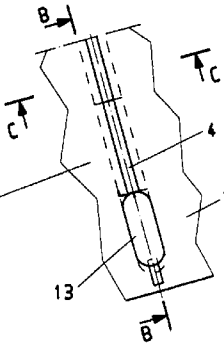
FIG. 4 is an enlarged view of the encircled portion of FIG. 1.
Figure 1:
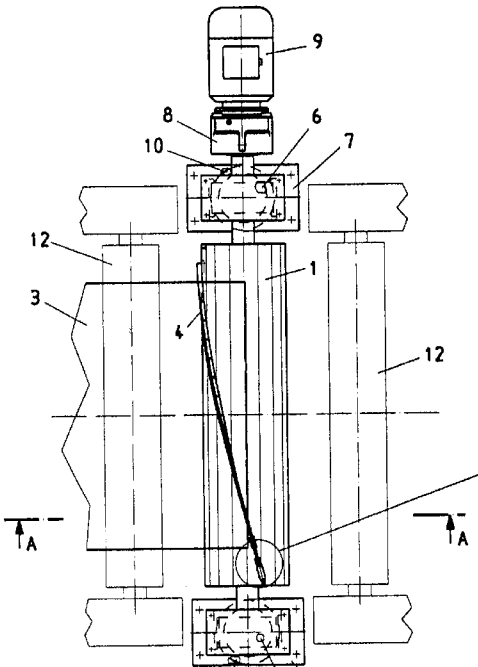
FIG. 1 is a top plan view of a first embodiment of a deburrer in accordance with the present invention.
Figure 7:
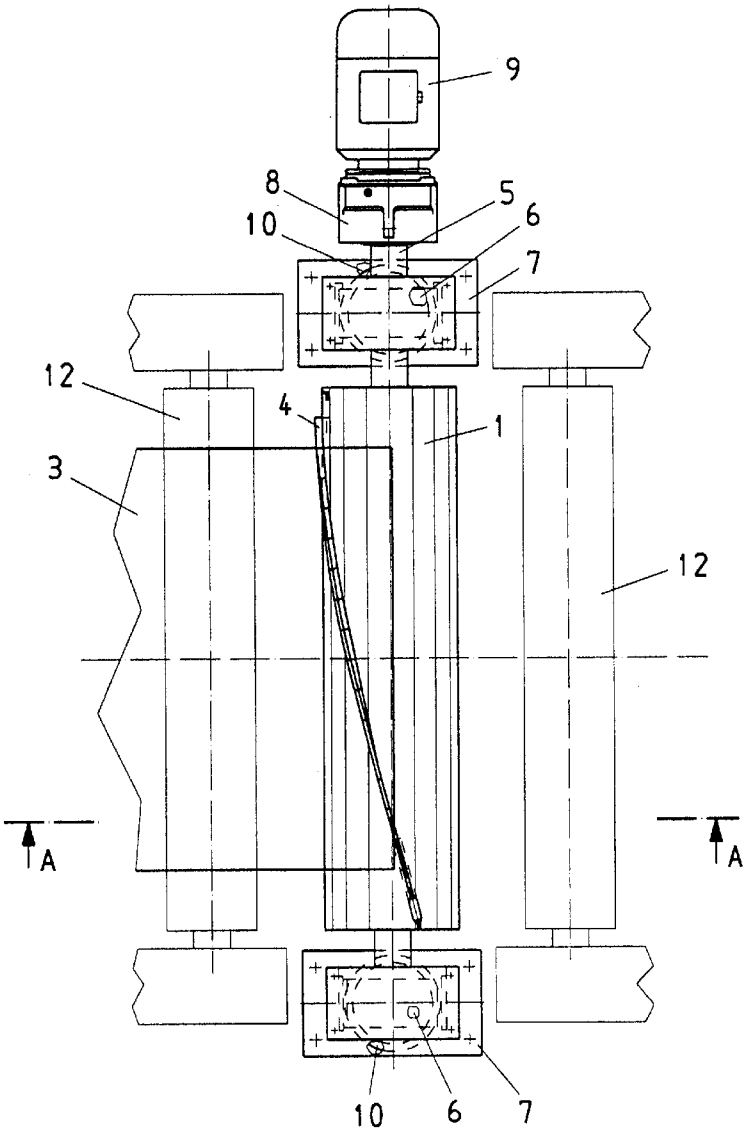
FIG. 7 is an enlarged view of FIG. 1.
Figure 8:
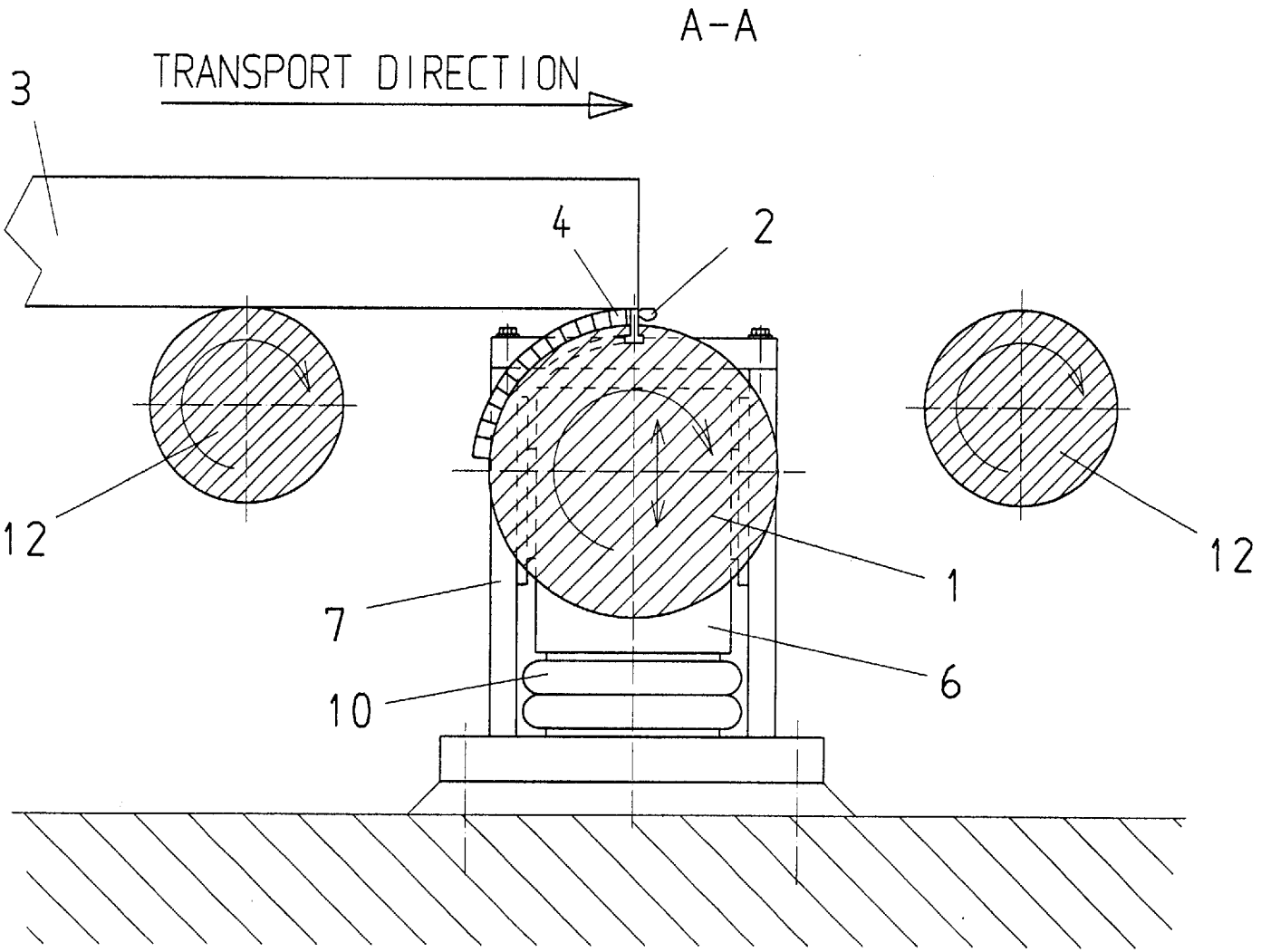
FIG. 8 is an enlarged view of FIG. 2.
Figure 9:
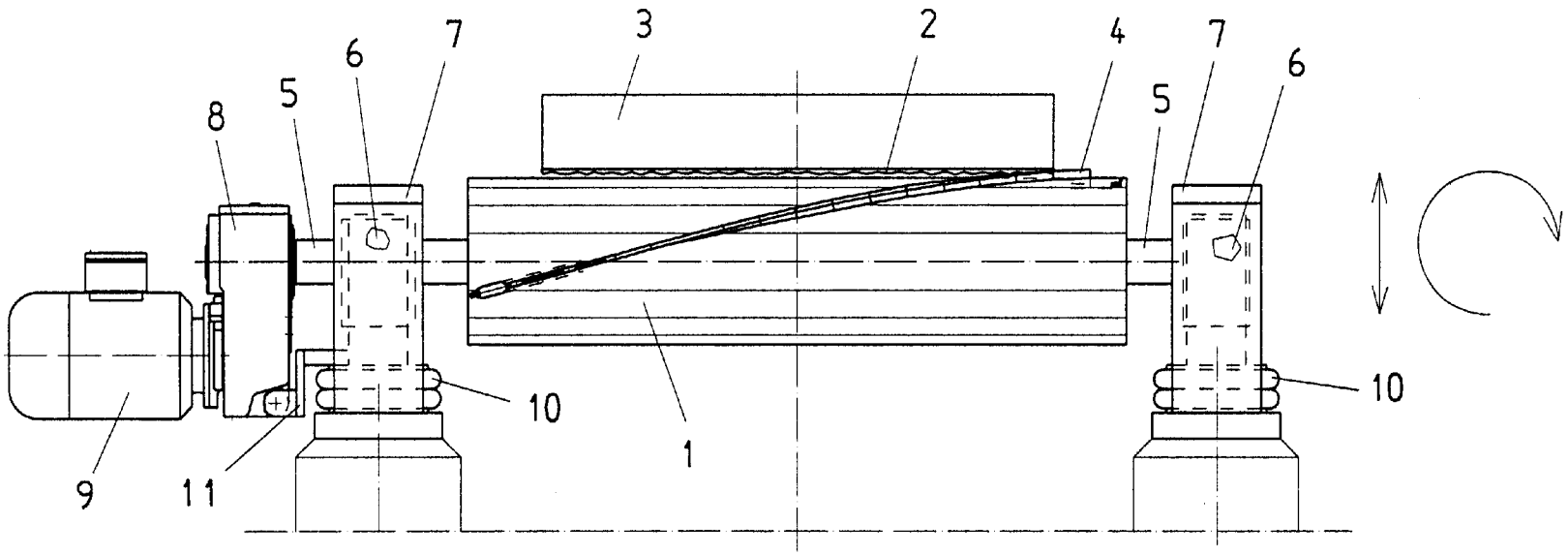
FIG. 9 is an enlarged view of FIG. 3.
Figure 13:
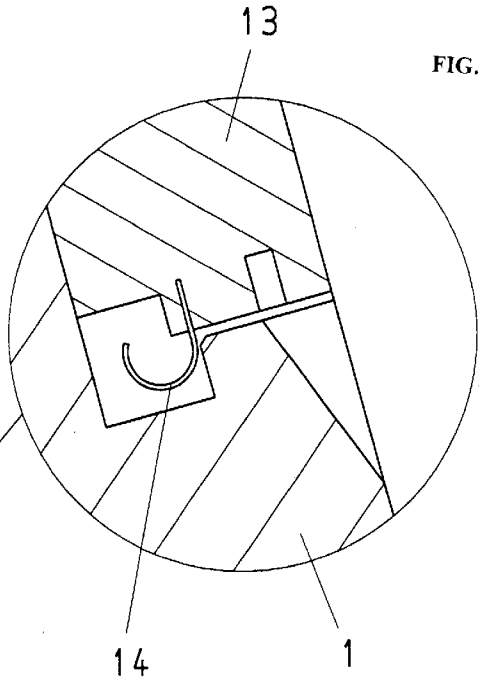
FIG. 13 is an enlarged view of the encircled portion of FIG. 11.
Figure 11:
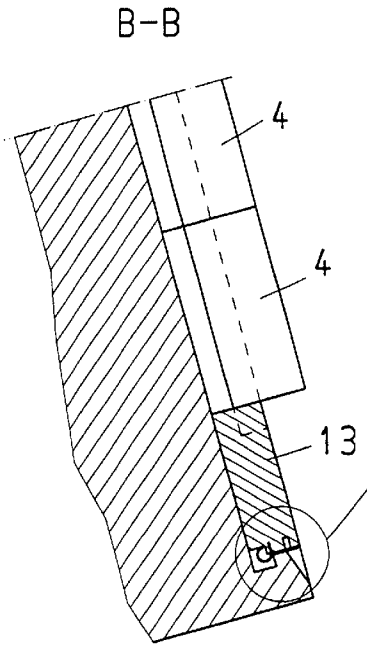
FIG. 11 is an enlarged view of FIG. 5.
Figure 12:
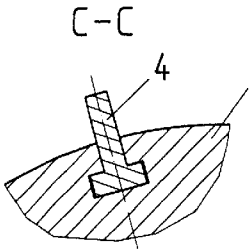
FIG. 12 is an enlarged view of FIG. 6.
Figure 10:
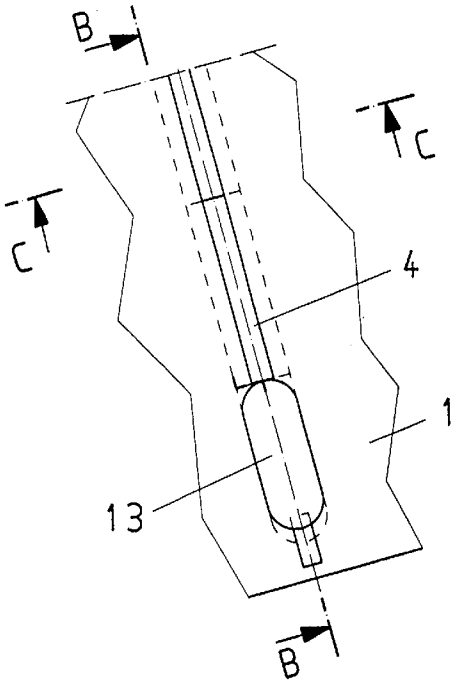
FIG. 10 is an enlarged view of FIG. 4.
Figure 16:
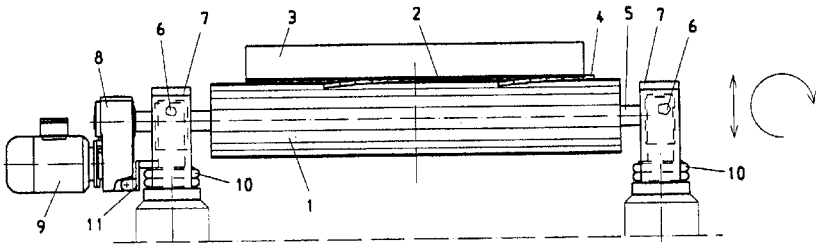
FIG. 16 is a side elevational view of the second embodiment.
Figure 18:
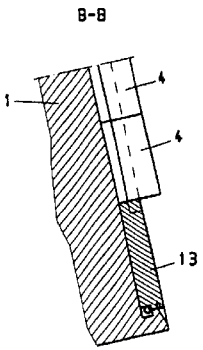
FIG. 18 is a sectional view as taken along line B—B of FIG. 17.
Figure 19:
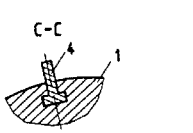
FIG. 19 is a sectional view as taken long line C—C of FIG. 17.
Figure 17:
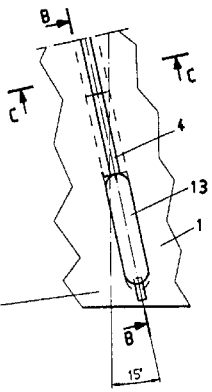
FIG. 17 is an enlarged view of the encircled portion of FIG. 14.
Figure 15:
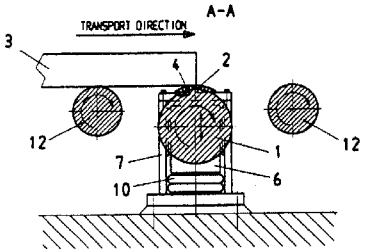
FIG. 15 is a sectional view as taken along line A—A of FIG. 14.
Figure 14:
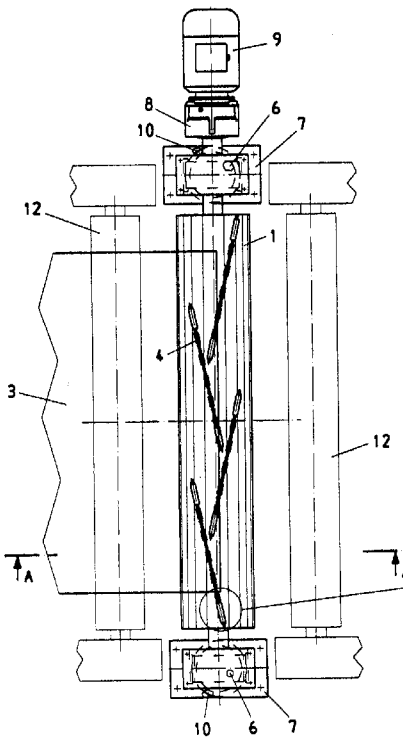
FIG. 14 is a top plan view of a second embodiment of a deburrer in accordance with the present invention.
Figure 20:
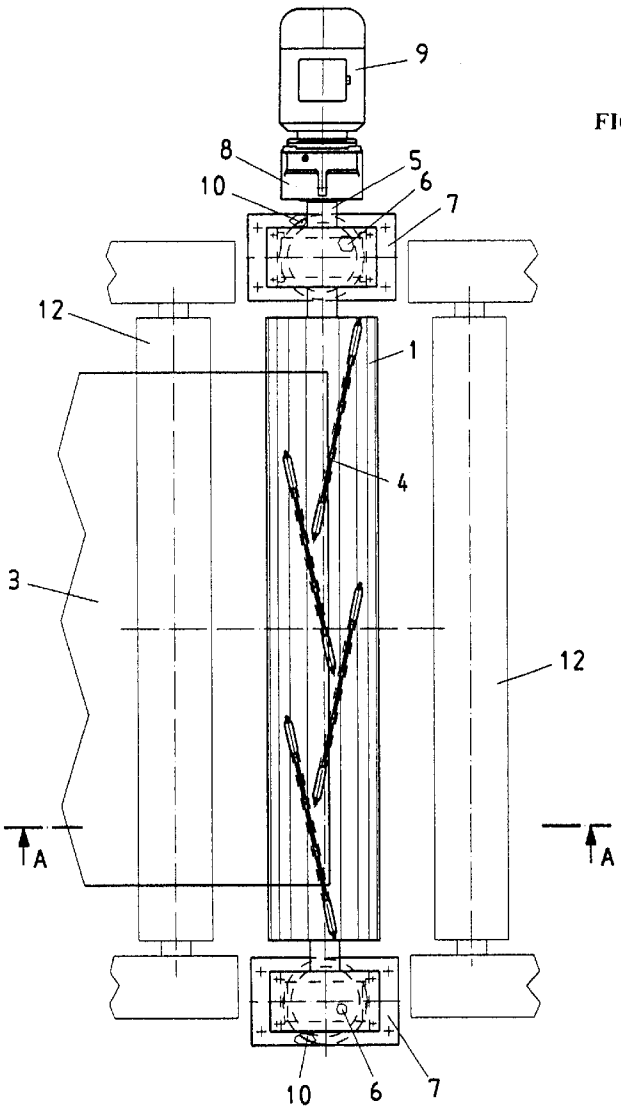
FIG. 20 is an enlarged view of FIG. 14.
Figure 21:
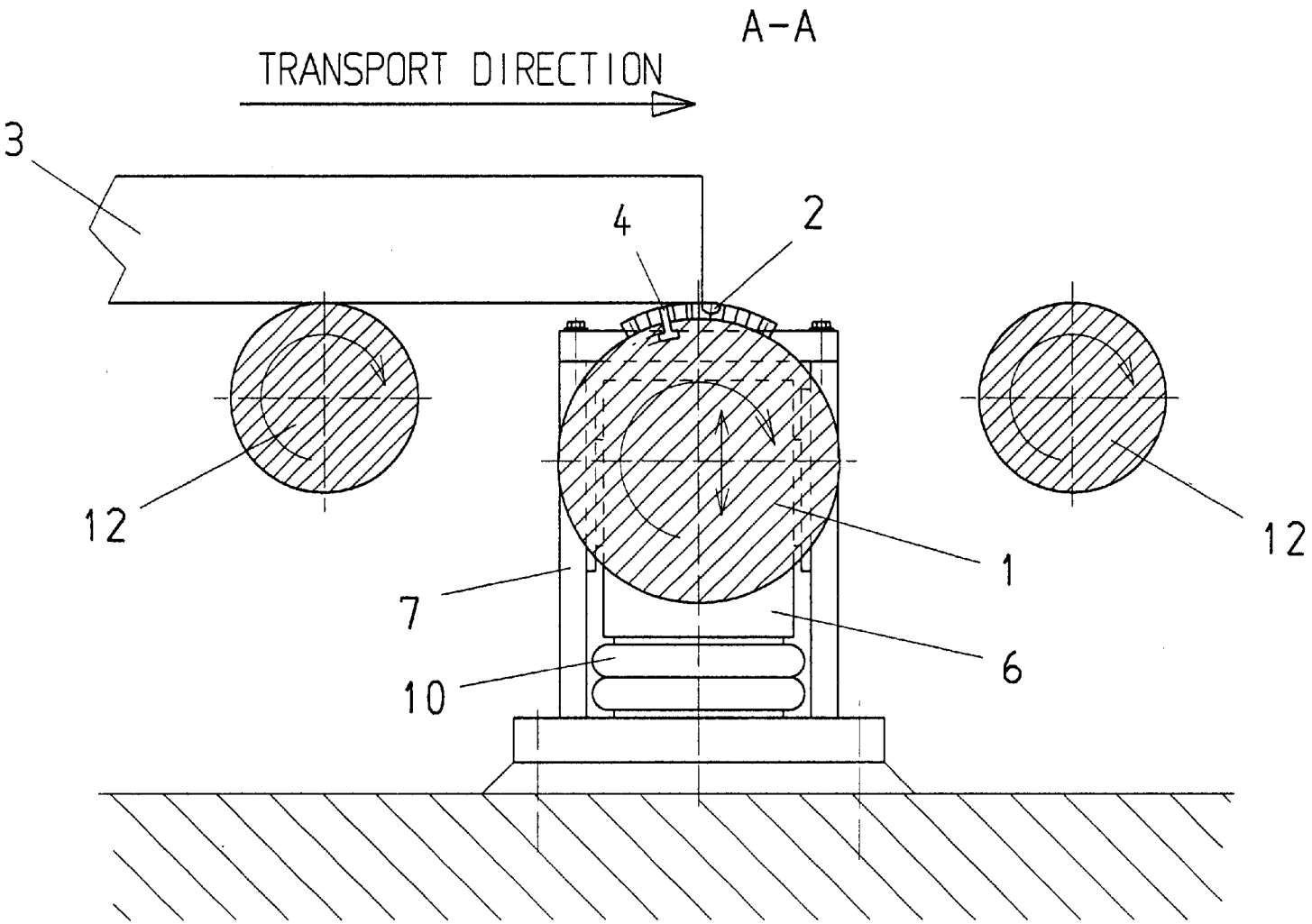
FIG. 21 is an enlarged view of FIG. 15.
Figure 22:
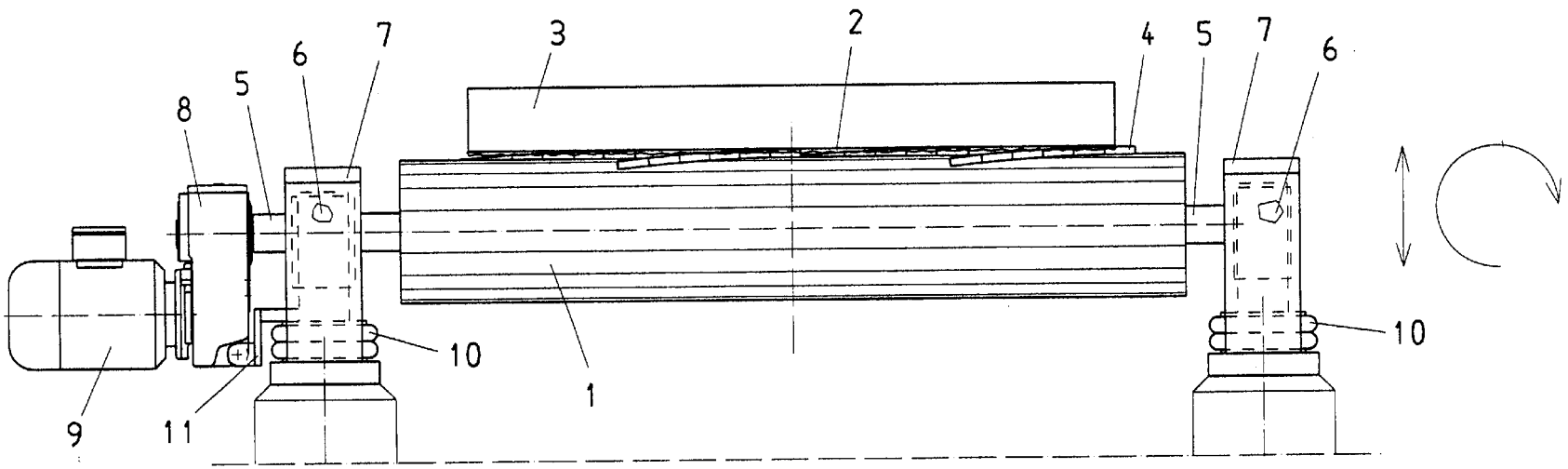
FIG. 22 is an enlarged view of FIG. 16.
Figure 29:
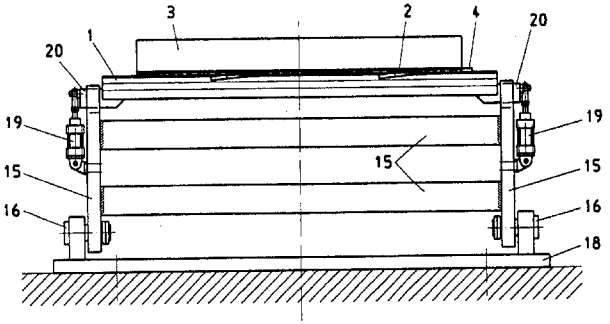
FIG. 29 is a right side elevational view of the third embodiment.
Figure 28:
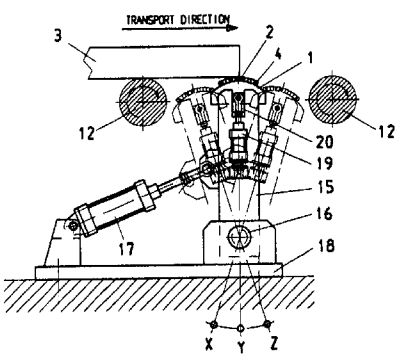
FIG. 28 is a front elevational view of the third embodiment.
Figure 30:
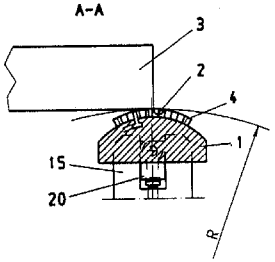
FIG. 30 is a sectional view as taken along line A—A of FIG. 27.
Figure 32:
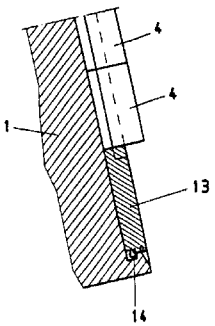
FIG. 32 is a sectional view as taken along line B—B of FIG. 31.
Figure 33:
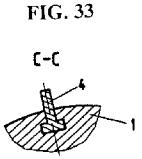
FIG. 33 is a sectional view as taken along line C—C of FIG. 31.
Figure 31:
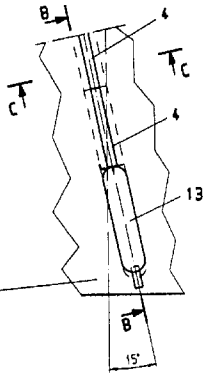
FIG. 31 is an enlarged view of the encircled portion of FIG. 27.
Figure 27:
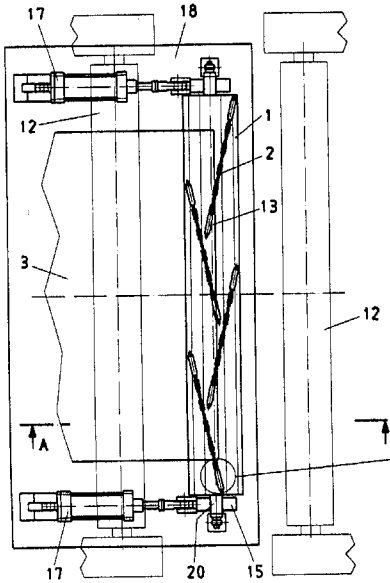
FIG. 27 is a top plan view of a third embodiment of a deburrer in accordance with the present invention.
Figure 34:
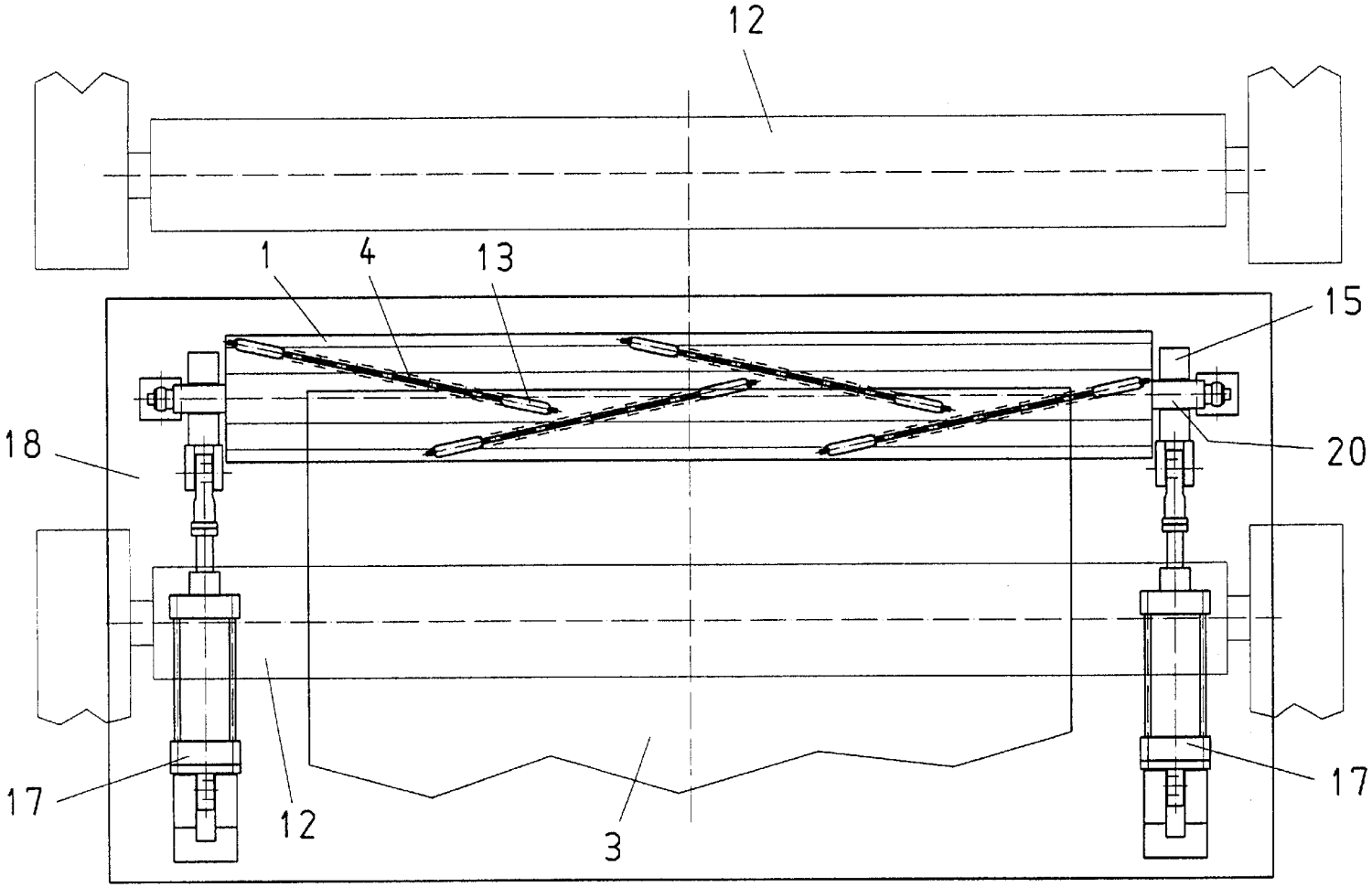
FIG. 34 is an enlarged view of FIG. 27.
Figure 35:
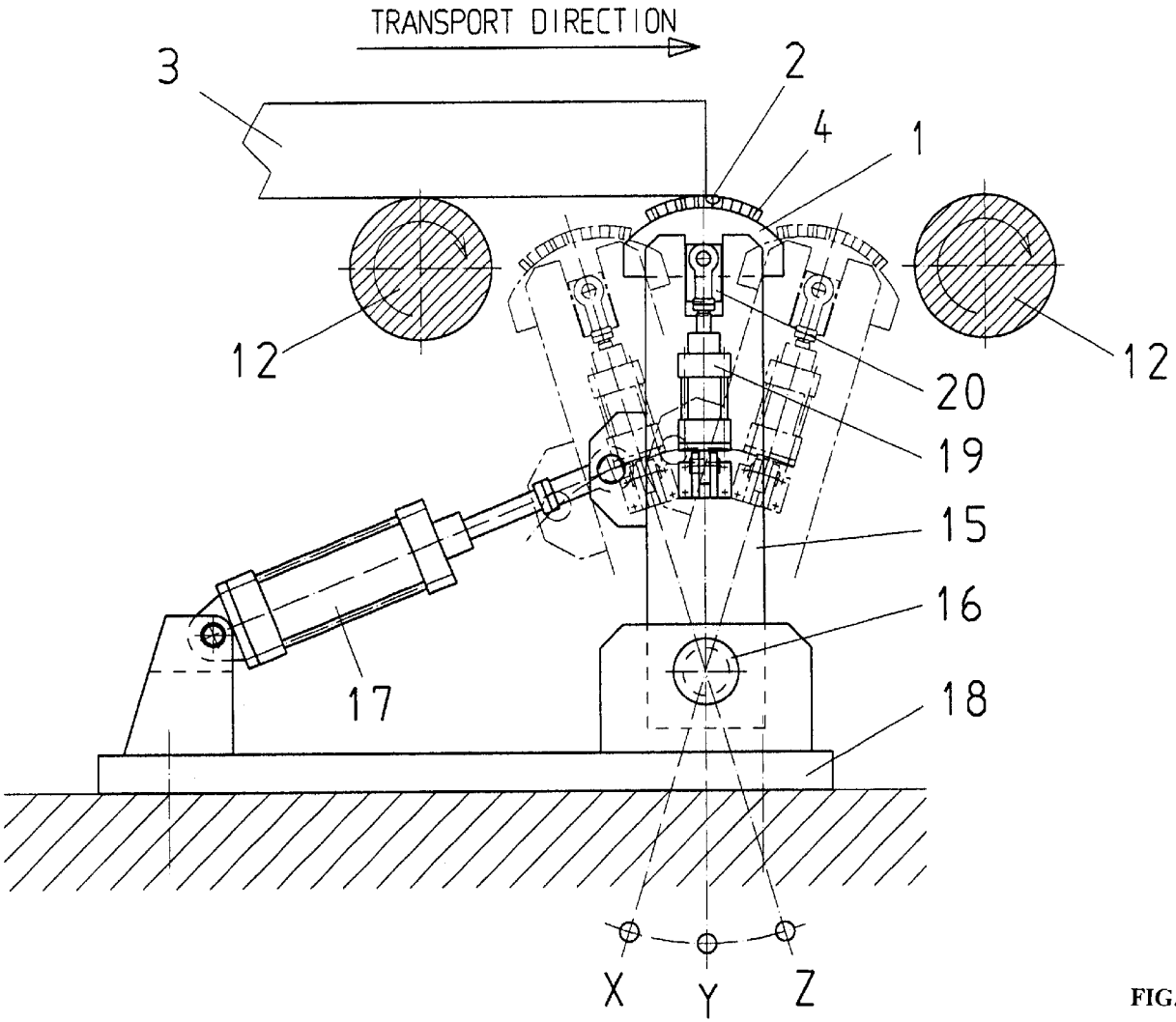
FIG. 35 is an enlarged view of FIG. 28.
Figure 36:
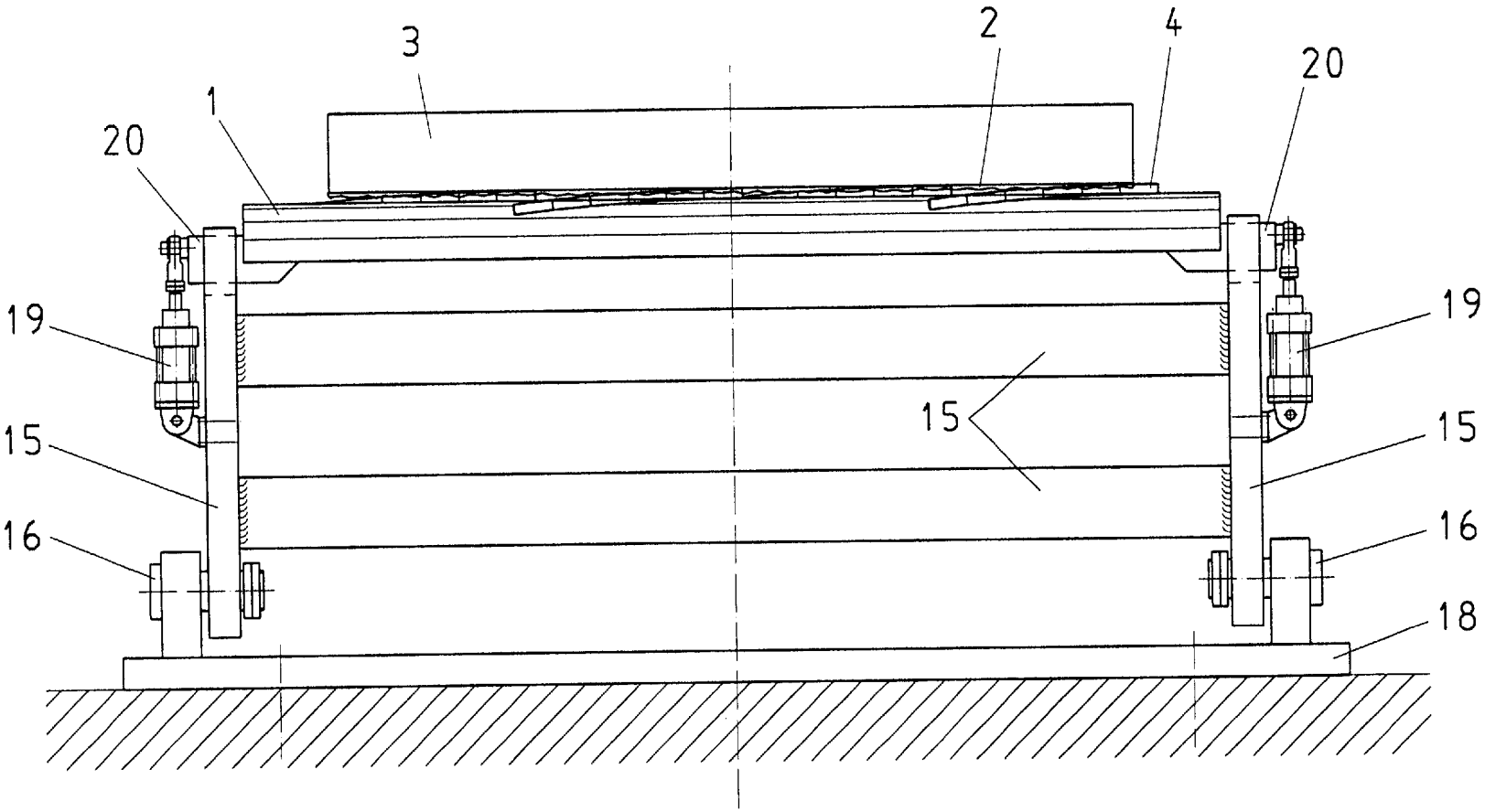
FIG. 36 is an enlarged view of FIG. 29.
Figure 43:
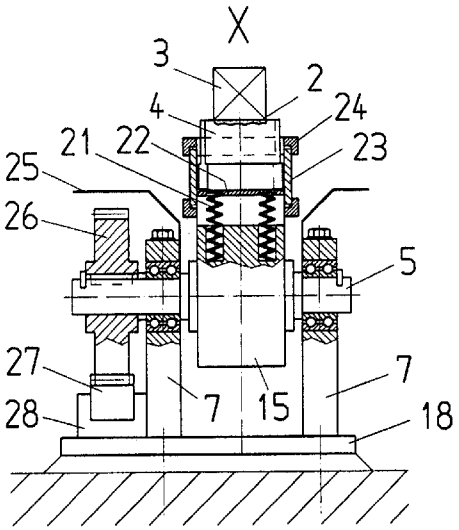
FIG. 43 is a right side elevational view of the fourth embodiment.
Figure 41:
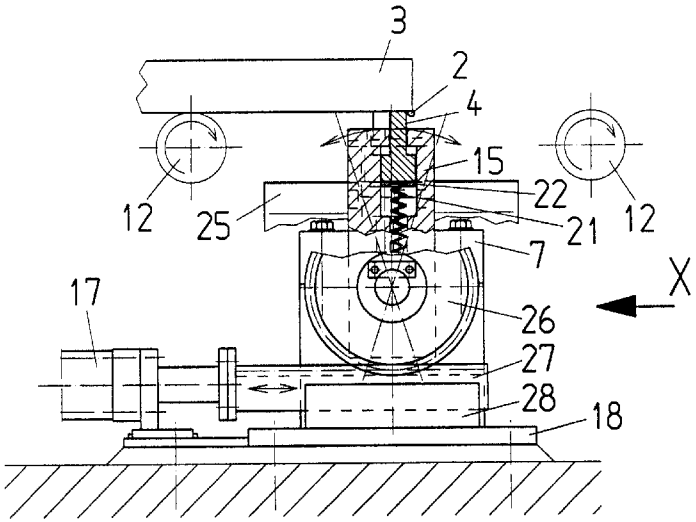
FIG. 41 is a front elevational view of a fourth embodiment of a deburrer in accordance with the present invention.
Figure 42:
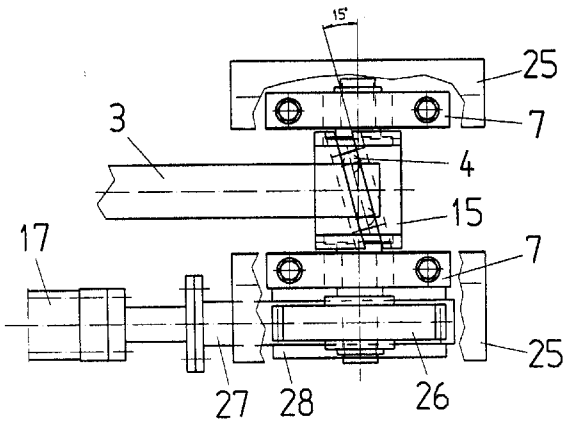
FIG. 42 is a top plan view of the fourth embodiment.
Figure 44:
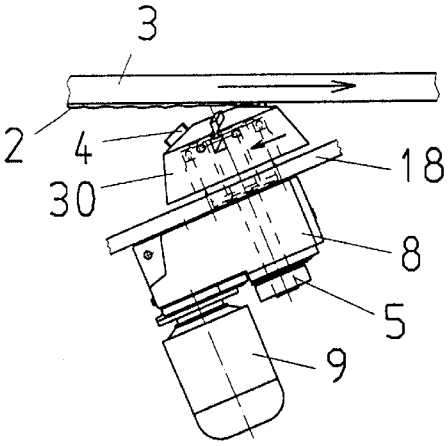
FIG. 44 is a front elevational view of a fifth embodiment of a deburrer in accordance with the present invention including a plurality of cutting members.
Figure 45:
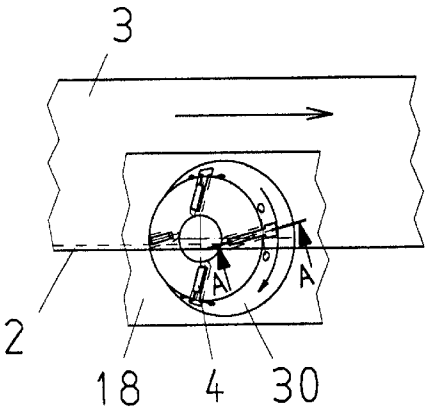
FIG. 45 is a top plan view of the fifth embodiment.
Figure 48:
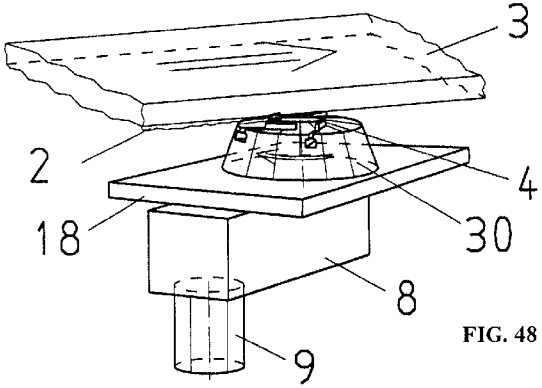
FIG. 48 is a perspective view of the fifth embodiment.
Figure 46:
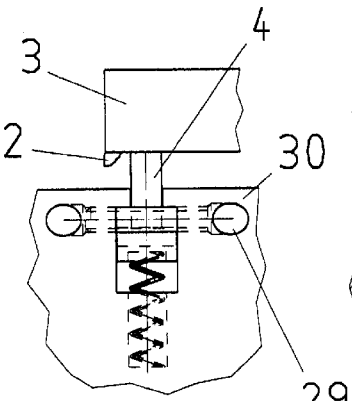
FIG. 46 is an enlarged end view, partially cut away, of a portion of the fifth embodiment.
Figure 47:
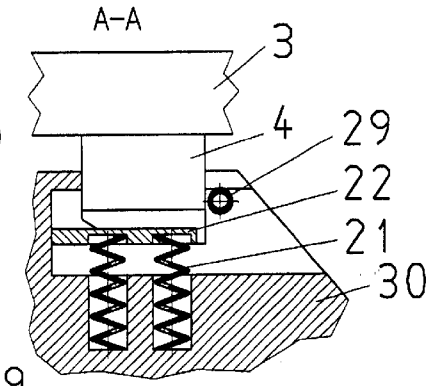
FIG. 47 is a sectional view as taken along line A—A of FIG. 45.
Figure 49:
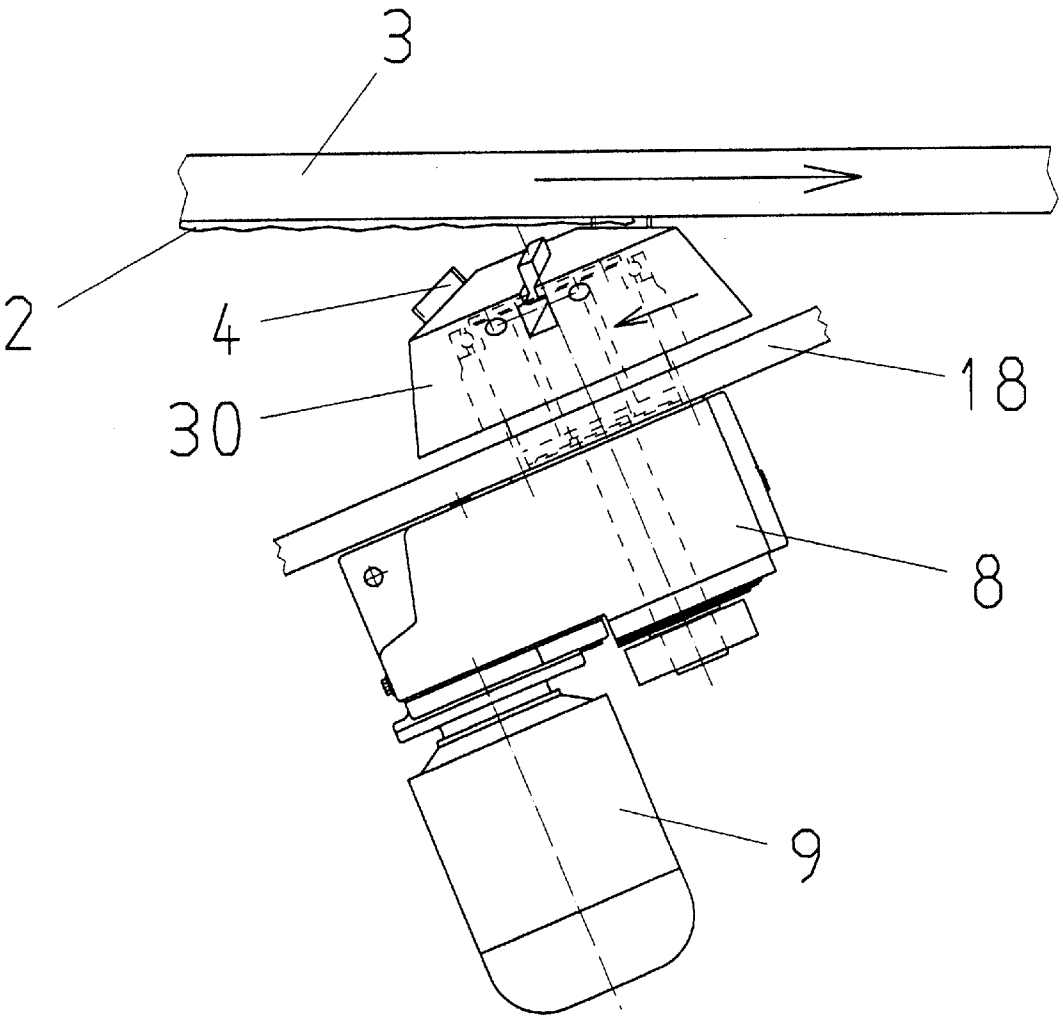
FIG. 49 is an enlarged view of FIG. 44.
Figure 50:
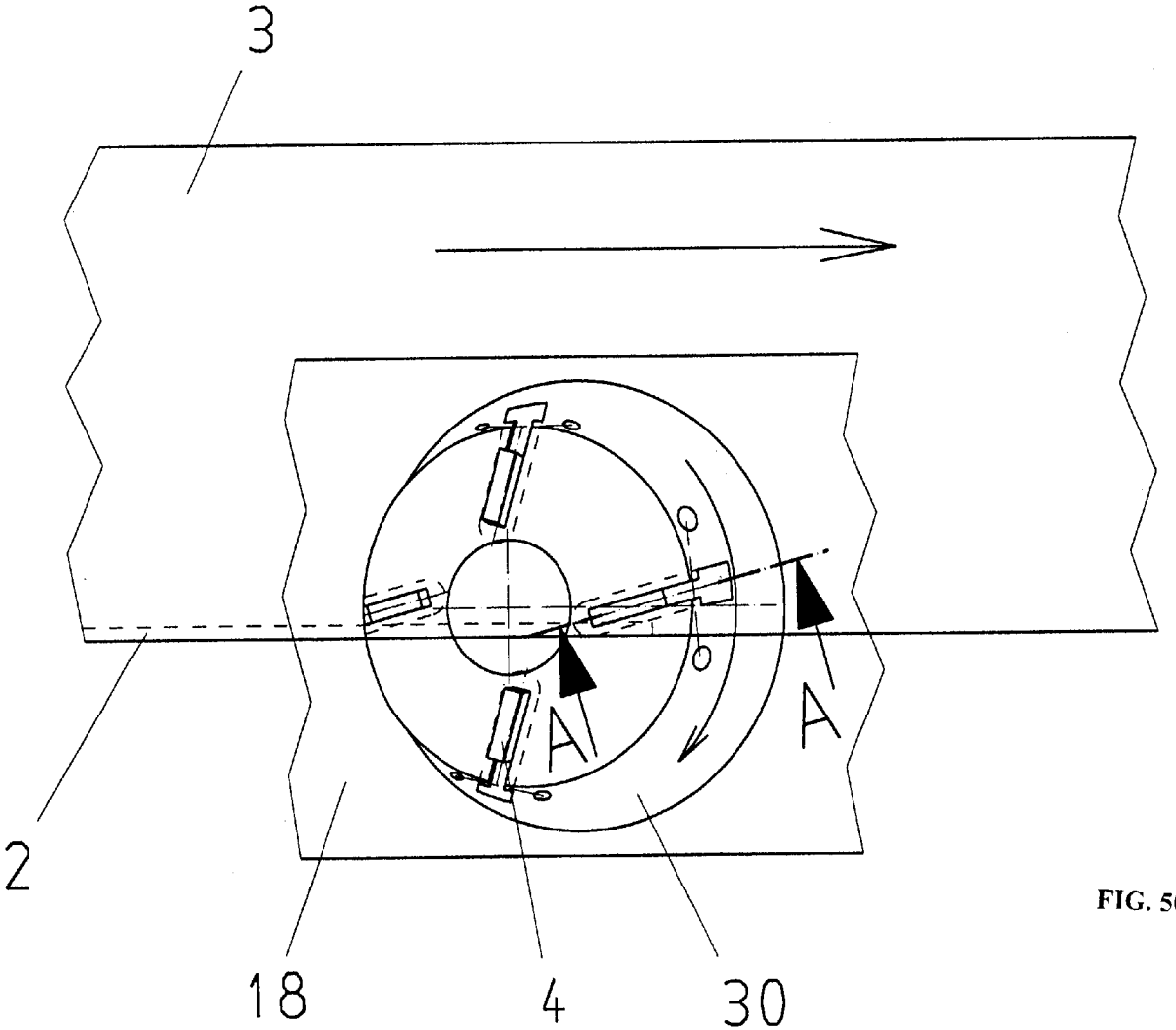
FIG. 50 is an enlarged view of FIG. 45.
Figure 52:
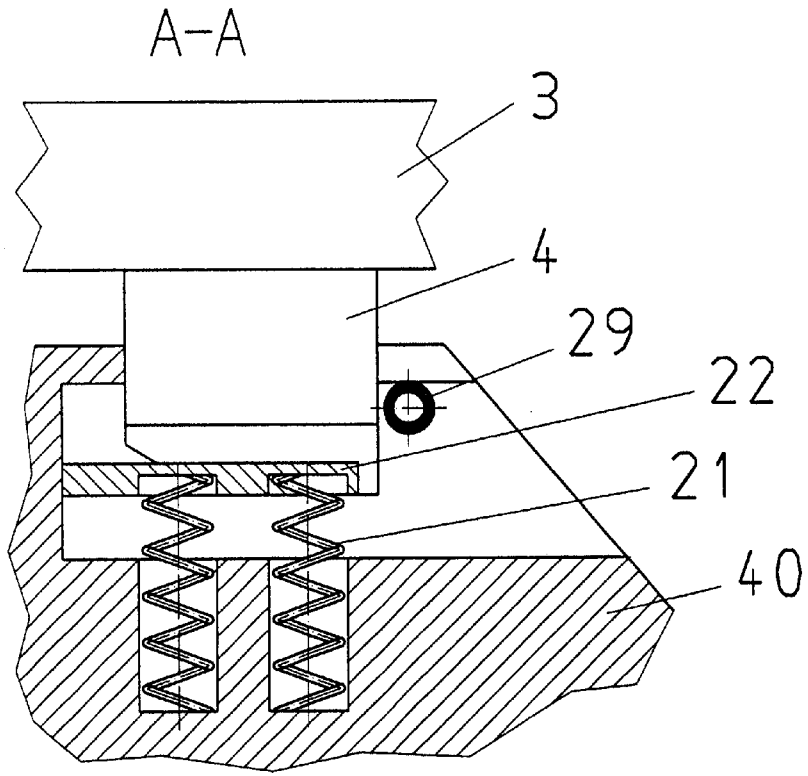
FIG. 52 is an enlarged view of FIG. 47.
Figure 51:
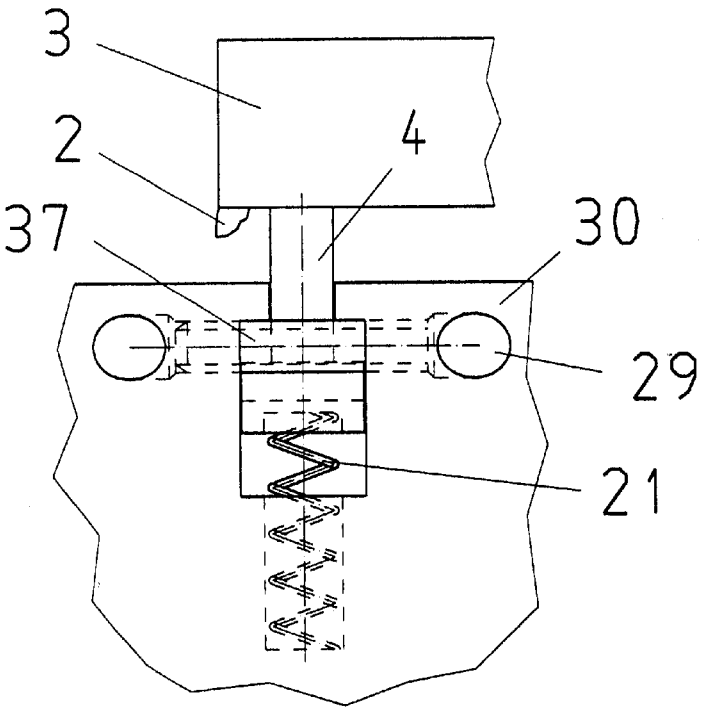
FIG. 51 is an enlarged view of FIG. 46.
Figure 53:
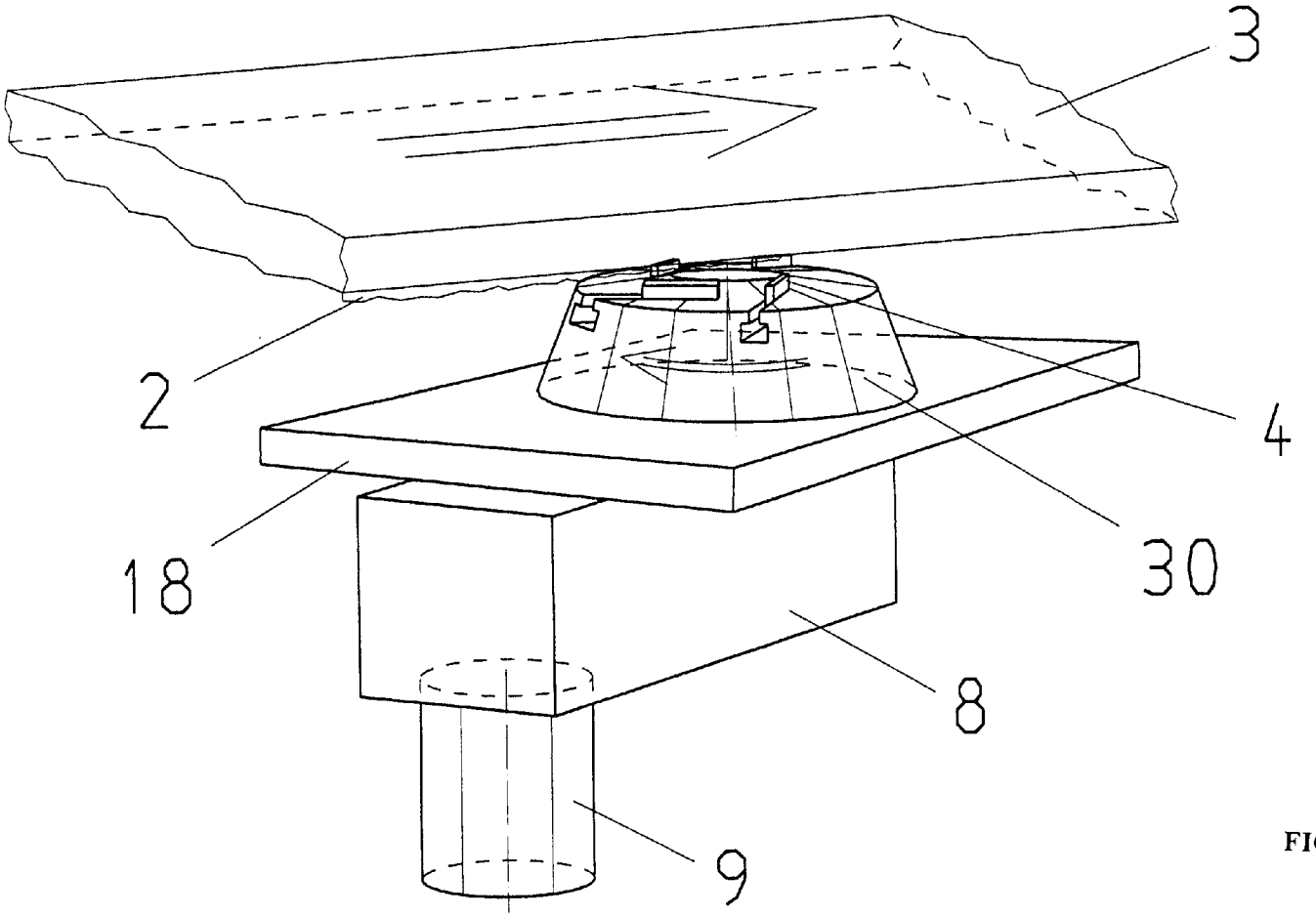
FIG. 53 is an enlarged view of FIG. 48.

The design of a scarfing deburrer (1) as shown in FIGS. 1–13 and described in the following is basically characterized by a design and an action which correspond to a scarfer respectively to a scarfing process, i.e., a cutting oxygen burr (2) or cutting beads (2) on a workpiece (3) are peeled or scarfed off and at that in an even continuous, rather slow motion of about 3 m/min. up to about 150 m/min. above the burr speed of a possibly burr long edge of the so-called scarfing blade (4), even if consisting of scarfing blade pieces of 20 mm. to 500 mm. long assembled forming the edge, along the workpiece (3) and pushing against the cutting oxygen burr (2). For this the scarfing blade (4) is arranged 15° with the oxygen burr and 75° with the forward movement direction of the scarfing blade (4). This scarfing blade (4) with a cutting=chisel angle=working angle of 30° to 90° is designed as a cutting blade spiral (4) or a double cutting blade spiral (4) with a burr corresponding entrance i.e. as a longitudinal spiral with a big diameter and a big pitch on the outside of a deburrer drum (1) or of a deburrer drum segment (1) as shown in FIGS. 27–40.

Therefore only one point of the scarfing blade (4) comes into contact with the workpiece at one rotation and with the cutting oxygen burr (2), as well in forward or backward direction, whereas the latter develops at least on one side by an elastically dampened lifting, when the other is adjusted to the level of the lower surface and rotates in a bearing there. This lifting respectively a relative rotation on the other side can as well be designed to be in the area of the foundation support.

The scarfing deburrer (1-18) suggested for this consists of the following elements with their relative functions (FIGS. 1–13): The deburrer drum (1) carries a scarfing blade spiral (4) for the scarfing of the oxygen cutting burr from the workpiece, which consists of a number of 20 mm. to 500 mm. long scarfing blade pieces (4) bent and twisted into a spiral shape form, and it is rotated with its axle stubs (5) in shifting bearings (6) guided liftably in corresponding bearing blocks (7) via a gear box (8) by motors. A lifting function to press the deburrer drum (1) with its upper portion of the scarfing blade spiral (4) against the workpiece (3) traveling on a roller table (12) from below is performed by bellow cylinder (10) below the shifting bearings (6) in the bearing blocks (7). Between gear boxes (8) and the bearing blocks (7) respectively the shifting bearings (6) anti-rotation levers (11) to prevent the drives to rotate are installed. It seems reasonable to adjust the one shifting bearing (6) corresponding to the normal level of the lower surface of the workpiece (3), to fix it and to operate with one continuously suitably following shifting bearing (6).

As well in FIGS. 1–13 the invention corresponding design of the scarfing blades as scarfing blade spiral (4) in inverted T-grooves or swallow tail grooves in the shell of the deburrer drum (1) can be recognized as scarfing blocks (4) pushed in one after the other with easy to put in and take out locking pieces (13) and a locking spring (14) at the end.

After the introduction of the scarfing blocks (4) into the spiral groove with a suitable angle of about 15° as suggested machined around into the deburrer drum (1), finally a suitable locking piece (13) with a locking spring (14) are pressed in.

To take out locking piece (13) and scarfing blocks (4) for quick and easy replacement, only the first has to be lifted out with a simple tool like a screwdriver, using the ramp machined into the shell of the deburrer drum (1).

Whereas FIGS. 1–13 show the scarfing deburrer (1-18) with a scarfing blade spiral (4) laid around the shell of the deburrer drum (1) in relation to the pitch and the diameter as well as to the length of the shell, it is easy to recognize that the design in accordance with the invention as per FIGS. 14–26 more than one scarfing blade around in a scarfing blade spiral several of the scarfing blades in portions complete with locking pieces and are arranged in opposite directions around the shell. For this there are several reasons:

- in spite of the complete deburring by the scarfing burr, pieces are produced which can easier be discharged;
- the drum area required to overtake the cutting oxygen burr (2) is smaller and the movement relations can easier be adjusted;
- individual scarfing blocks are easier to be replaced in cases of wear or repair; and
- for wider workpieces (3) i.e. slabs no bigger deburrer drum diameters (1) are required.

These considerations finally led to the design of a scarfing deburrer (1-20) as per FIGS. 27–40. Instead of a cylindrical drum with big diameter only a deburrer drum segment (1) with a big radius of the basic cylinder is used and height adjustably arranged in the deburrer lever frame (15). The lever frame (15) in swiveling bearings (16) is installed on a support plate (18) and will be deburring the front end of an arriving workpiece (3) with its cutting oxygen burr (2) overtaking the latter when traveling from a starting position X via a middle position Y into an end position Z. A deburring motion in opposite direction is used to deburr the foot or end of the workpiece when it arrives in the deburring area.

The deburrer drum segment (4) is height adjustable by means of lifting cylinders (19) and lifting slides (20) in slot guides at the upper part of the deburrer lever frame in order to balance out height motions, convex and concave shapes of the lower surface of the workpiece (3). Other design variations can be derived from the above and later given parts of descriptions.

A scarfing deburrer for narrow workpieces (3) i.e. blooms and billets operates similarly. A deburrer lever (15) rotating with axle stubs (5) in bearing supports (7) carries at its upper end in a T- or swallow tail groove a scarfing blade which can be pressed up and on by means of a lifting spring (21) and which has an edge corresponding to the ideal deburrer drum. The depth of the scarfing blade groove allows a guided depression of the scarfing blade (4). On the sides the scarfing blade groove is limited by wedge type formed holding plates wedged into suitable holding pieces and the lifting springs (21) sitting in guiding bores carry a pressure plate (22), which facilitates a pushing in of the scarfing blade (4) from the side after pressing it down. A drive pinion (26) in an elongated axle stub working with the rack portion of the pushing/pulling rod in the pushing rod guide on the bearing plate (18) and is traveling in synchronism of the relative movement of the cutting oxygen burr (2). A driving cylinder with joints could as well work directly with the deburrer lever.

FIGS. 44–58 show a scarfing deburrer (1-30) which uses the principles of the scarfing deburring for an endless application, i.e. practically for long, longitudinally oxy-cut workpieces (3).

On a base plate slightly inclined in the traveling direction of the workpiece (3) an axle stub (5) with a gear box (8) and a drive (9) rotate a deburrer plate (30). This is designed on its top surfaces in a conic shape corresponding to the inclination of the base plate (18), subsequently it is in its horizontal axis of its run-out side for the workpiece (3) parallel to its lower surface and also the edge of a scarfing blade (4). In this conic face the scarfing blades (4) are sitting alternately and sideways parallel beside a middle axis pair, whereby when rotating against the cutting oxygen burr (2) the latter is touched at first from the inner, sharply edged portion of the scarfing blade (4) nearer to the middle of the deburrer plate (30) and broken through, thereafter the scarfing of this portion of a cutting oxygen burr (2) with the edge of the scarfing blade is performed.

With opposite rotation of the deburrer plate (30), a piece by piece continuous scarfing of a maybe uninterrupted oxygen cutting burr (2) is performed, arrangements of scarfing blades (4) on the middle axis are possible for this.

Apart from the design to press shear caps with upward pushing pistons in compressed air cylinders against the lower surface of the workpiece (3), the rotating lifting of the scarfing blades (4) with the help of the inclined arrangement of the deburrer plate (30) as well allows a spring loaded design of the scarfing blade (4) installation.

As described before, the scarfing blade (4) is sitting in a T- or swallow tail groove (inverted) and on a pressure plate (22) over the elastic lifting springs (21). The only to one side open groove can be closed by a removable pin (29) for simple exchange.

The design of the scarfing blade (4) can be extended at its inner portion to a parallelogram shape scarfing block (4) in order to increase its breaking effect of the oxygen scarfing burr (2) for a piece after piece deburring and for better discharge by a widening of the portion showing to the interior.

Figure 54:
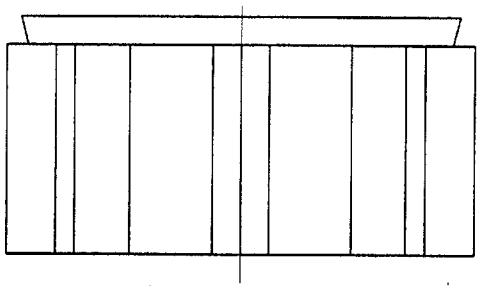
FIG. 54 is a front elevational view of a different configuration of a cutting member that can be used in conjunction with the fifth embodiment.
Figure 55:
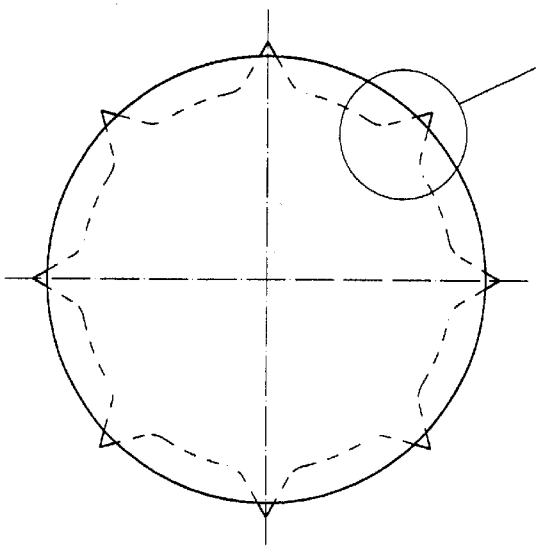
FIG. 55 is a top plan view of the different configuration of the cutting member.
Figure 56:
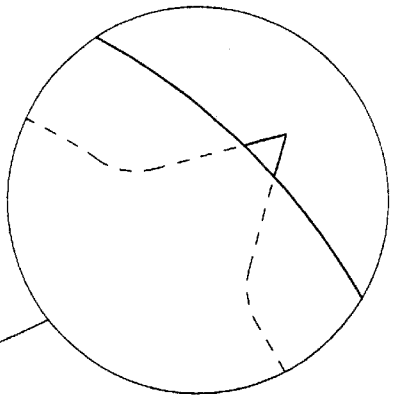
FIG. 56 is an enlarged view of the encircled portion of FIG. 55.
Figure 58:
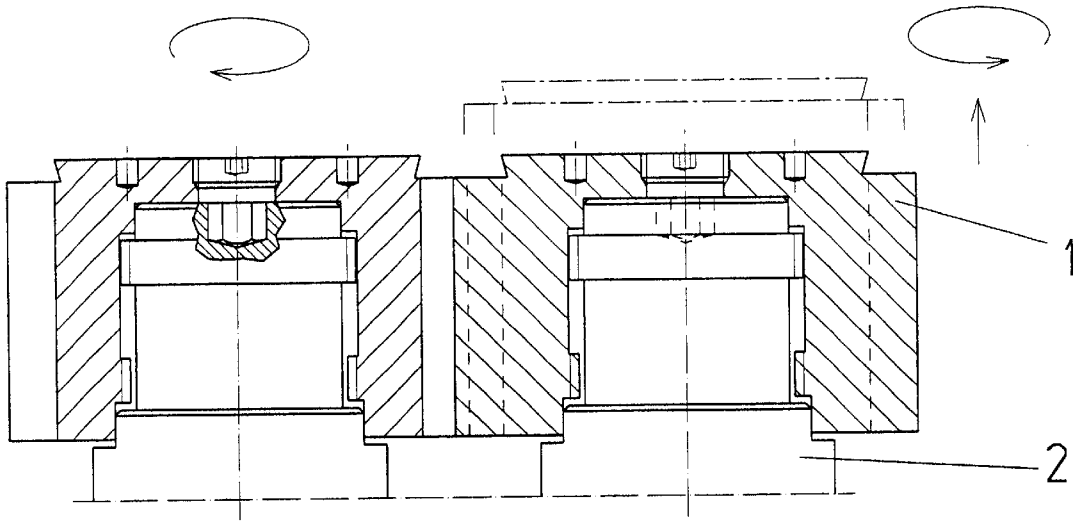
FIG. 58 is a sectional view as taken along line B—B of FIG. 57.
Figure 57:
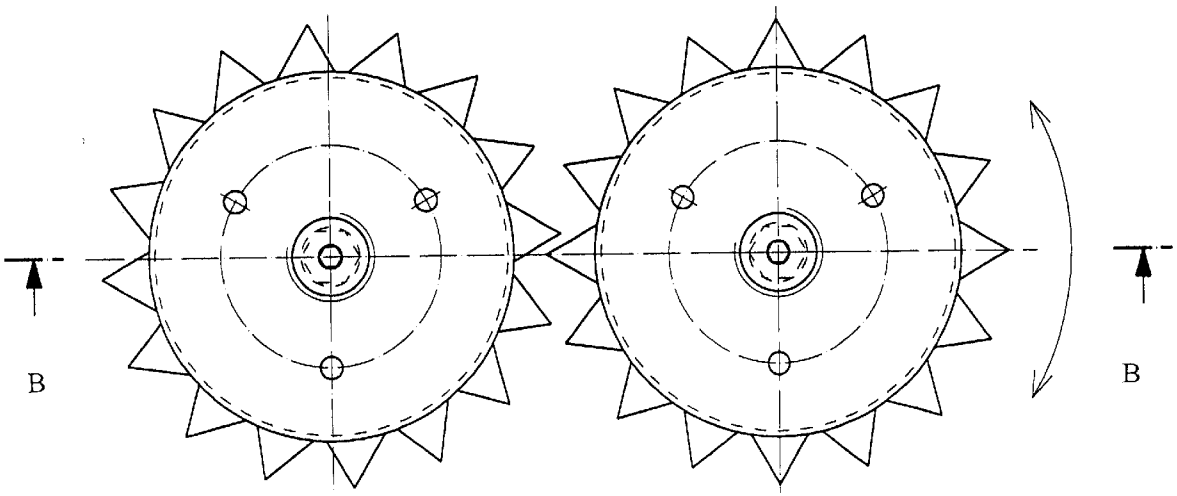
FIG. 57 is a top plan view, partially cut away, of an adjacent pair of the different configuration of the cutting members that are engaged gear-wise with one another.
Figure 60:
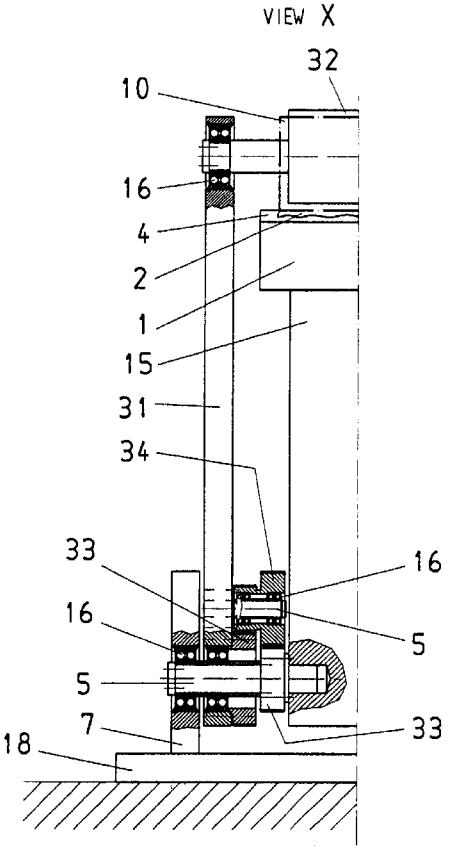
FIG. 60 is a right side elevational view of the sixth embodiment engaging the leading end of the workpiece.
Figure 59:
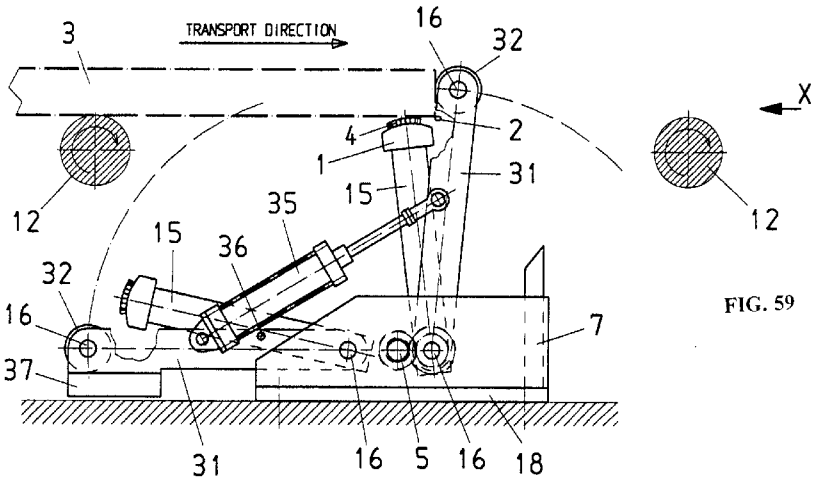
FIG. 59 is a front elevational view of a sixth embodiment of a deburrer in accordance with the present invention that is engaged with a leading end of a workpiece.
Figure 61:
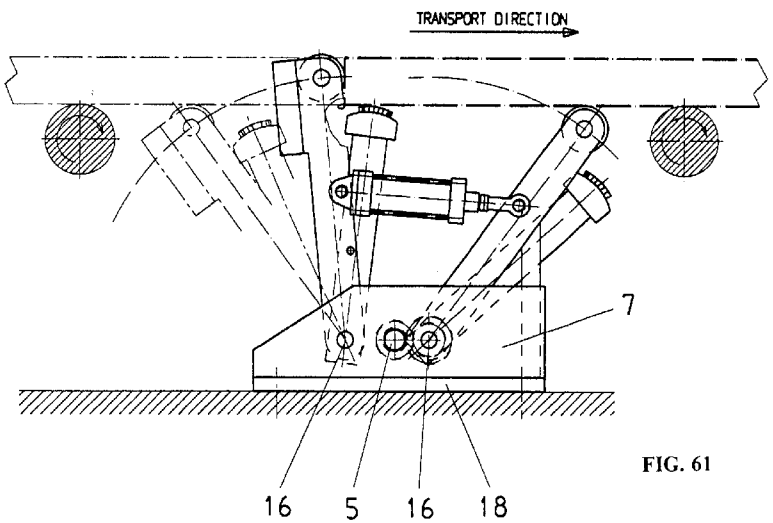
FIG. 61 is a front elevational view of the sixth embodiment engaging a trailing end of the workpiece.
Figure 63:
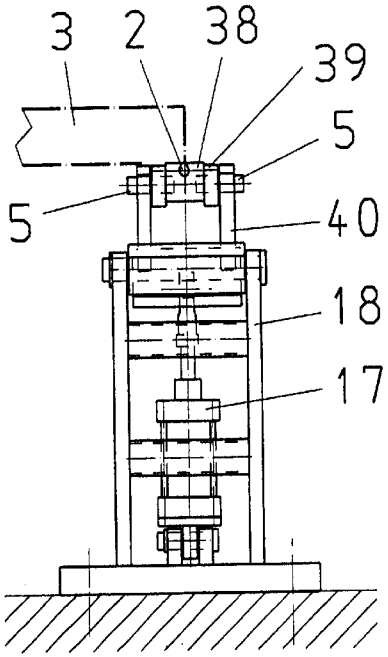
FIG. 63 is a right side elevational view of the notching apparatus.
Figure 62:
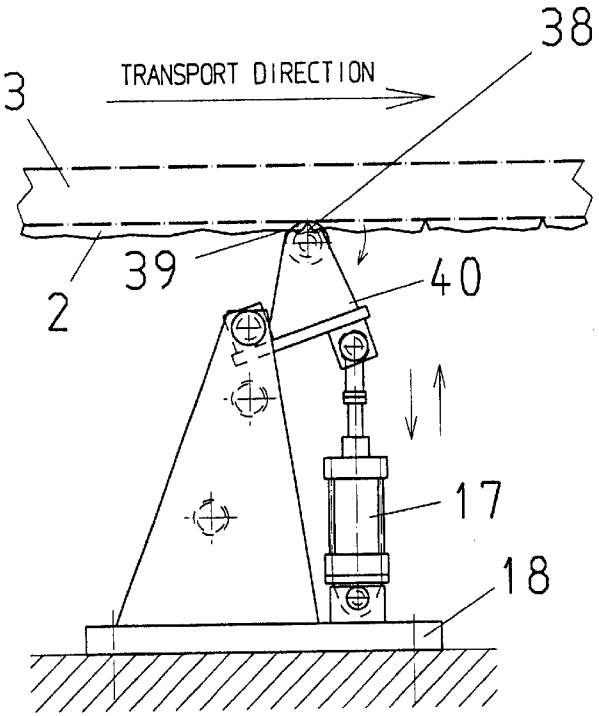
FIG. 62 is front elevational view of a notching apparatus including a notching lever in accordance with the present invention.
Figure 64:
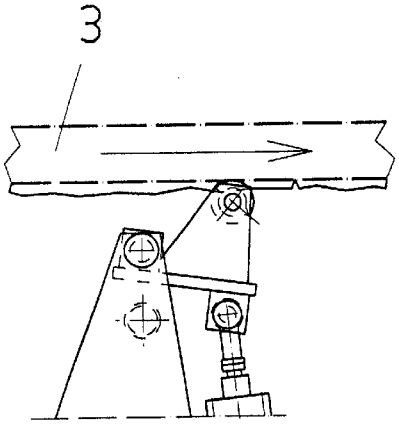
FIG. 64 is a front elevational view of a portion of the notching apparatus.
Figure 65:
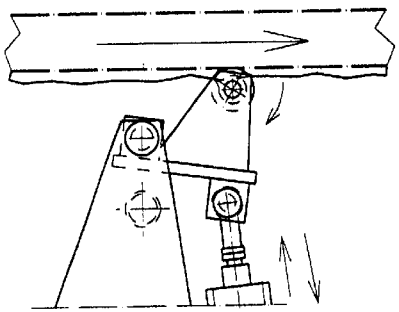
FIG. 65 is a front elevational view of a portion of the notching apparatus.
Figure 67:
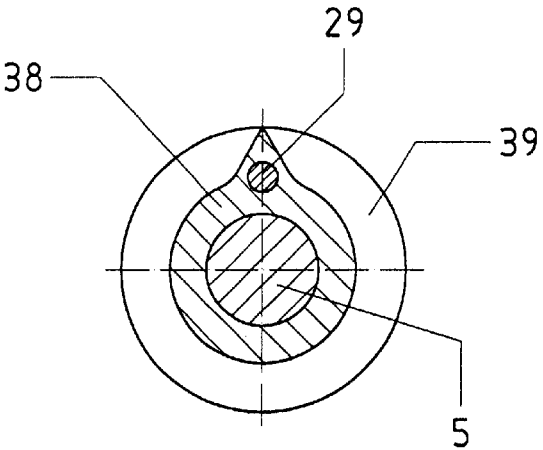
FIG. 67 is a sectional view as taken along the line A—A of FIG. 66.
Figure 66:
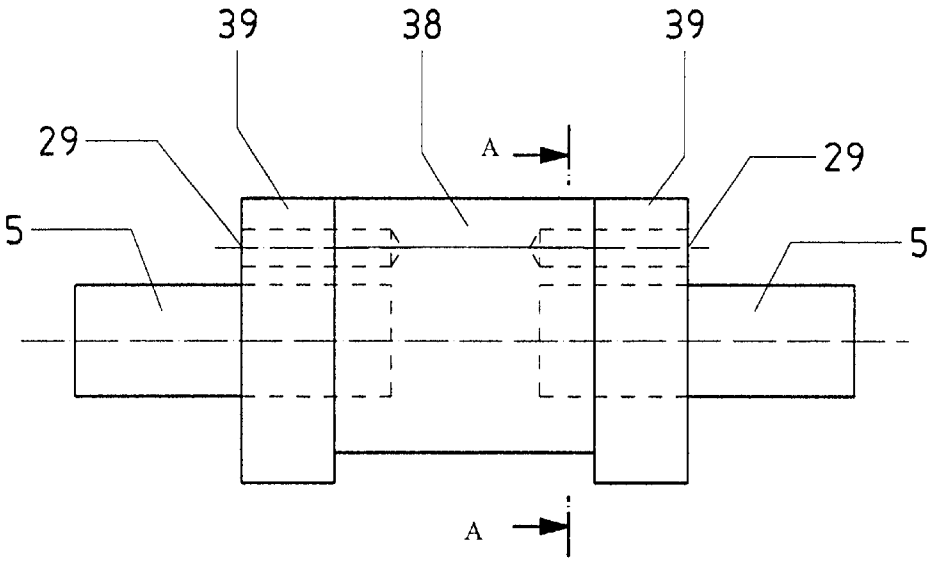
FIG. 66 is an enlarged side elevational view of a portion of the notching lever.

As well a special form of the inner, primarily contacting corners by chisel type projections is possible, if these are arranged with an angle of 90° to 150°. Otherwise shear cap type, round scarfing blocks (4) are possible, but which should work only for scarfing with the quarter of their circumference direct towards the cutting oxygen burr (2) and which are made with vertical edges all around the round chisel-type edge, as shown in FIGS. 54–56, in order to better break the oxygen cutting burr to be scarfed-off. Such scarfing blocks (4) with round edges and projecting vertical edges can be used located very closely to each other as shown in FIGS. 57–58 in order that the teeth-like vertical edges comb with each other in a gear-wise manner and do not allow a sticking of rest pieces between the scarfing blocks (4), predominantly for cross-oxygen cutting burr after cross-cutting.

In relation to the designs according to FIGS. 1–43 and the respectively following FIGS., there is the possibility to build a scarfing deburrer (1-37) for crosswise separated workpieces (3) which does not need a motorized, pneumatic or hydraulic drive supplied from outside, but only driven by the thrust and the motions of the workpiece (3). This is reasonable and possible because the scarfing deburrer requires only a fraction of the deburring force compared with the deburring by pushing off or knocking off or shearing off with several shearing knifes, depending on material composition, temperature of the workpiece (3) and the oxygen cutting tip at standard working conditions. Of course the workpiece (3) has to be long, thick and wide i.e. heavy enough to take enough friction force from the roller table and transfer it into deburring energy.

Such a self-acting and self-controlling, strand-driven scarfing deburrer (1-38) consists of a pair of driving levers (31) with a rotatable drive roller (32) in the starting position on the level of the workpiece (3), installed rotatably at their lower ends in bearing blocks (7) on a bearing plate (18) and on this end have a gear wheel (33), which drives a gear wheel pair (34) on an axle stub (5) in a bearing block (18) for direction change and speed increase, which drive on the other hand further gear wheel (33) on the deburrer lever (15) to overtake the cutting oxygen burr (2) at the head (leading end) of the workpiece (3) and subsequently deburrs by rotation of a drum-like formed scarfing blade (4) at the upper end of the deburrer lever. This latter design with lifting spring (21), pressure plate (22) and holding plate (23) and holding pieces (24) on a deburrer drum segment (1) has been described before.

A spring pulling element (35) is connected to the driving lever (31), which pulls along a second drive lever pair (31) against the transport direction, when the first one is moved by the workpiece (3) and at such until it presses against the lower surface of the workpiece (3). Now the spring pulling element (35) is tensioned until the end of the workpiece (3) travels over the driving roller (32) and releases the drive lever pair (31). The second drive lever pair (31) on the entrance side lifts up with the force of the spring pulling element, supported by the first drive lever pair (31) which presses against the lower surface of the workpiece (3) on the exit side (trailing end), and pulls a stationary installed and exactly positioned deburrer lever (15) with known equipment into working position for a counter-acting deburring. Drive lever pair (31) and deburrer lever (15) are connected by a bolt (36) in suitable position with each other and the pulling weight (37) pulls the whole machine back into starting position, if the workpiece has passed the deburring area fully.

In addition to machines and equipment described above following devices can be used reasonable, depending on material composition of the relevant workpiece (3) and on deburring principle.

For though steels and for longitudinal deburring of workpieces (3), despite other known and suggested methods unlimited long, at least undefined long oxygen cutting burr (2) pieces scarfed-off can develop depending on material composition and can only be discharged with difficulties. Under circumstances they can even get stuck and block the equipment.

Therefore a notching chisel (38) as seen in FIGS. 62–70 which is accompanied by two anvil disks (39), which sit together at the end of a rotatable notching lever (40) and are thrust by a knocking cylinder (17) on a common support plate in regular distances/intervals notching against the oxygen cutting burr (2) from below, whereby the anvil disks avoid damages of the lower side of the workpiece (3) by the notching chisel (38).

Figure 69:
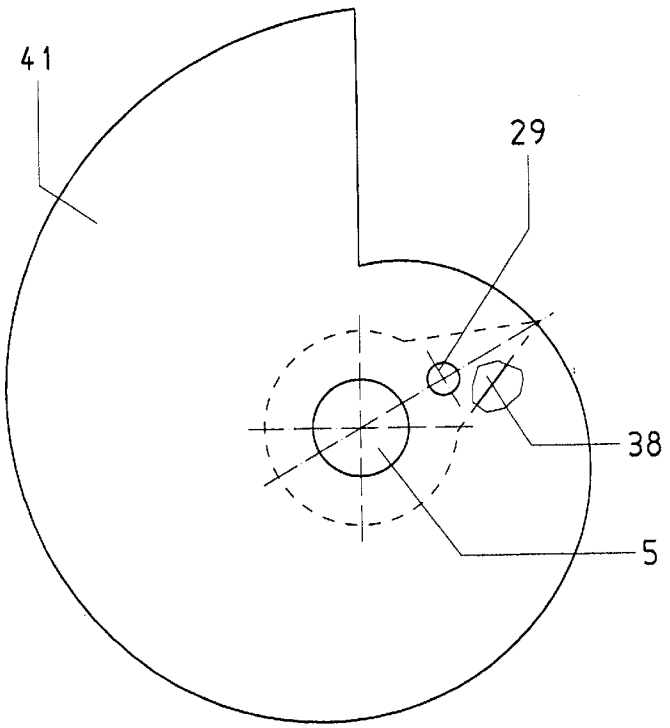
FIG. 69 is a front elevational view of the second configuration of the portion of the notching lever.
Figure 68:
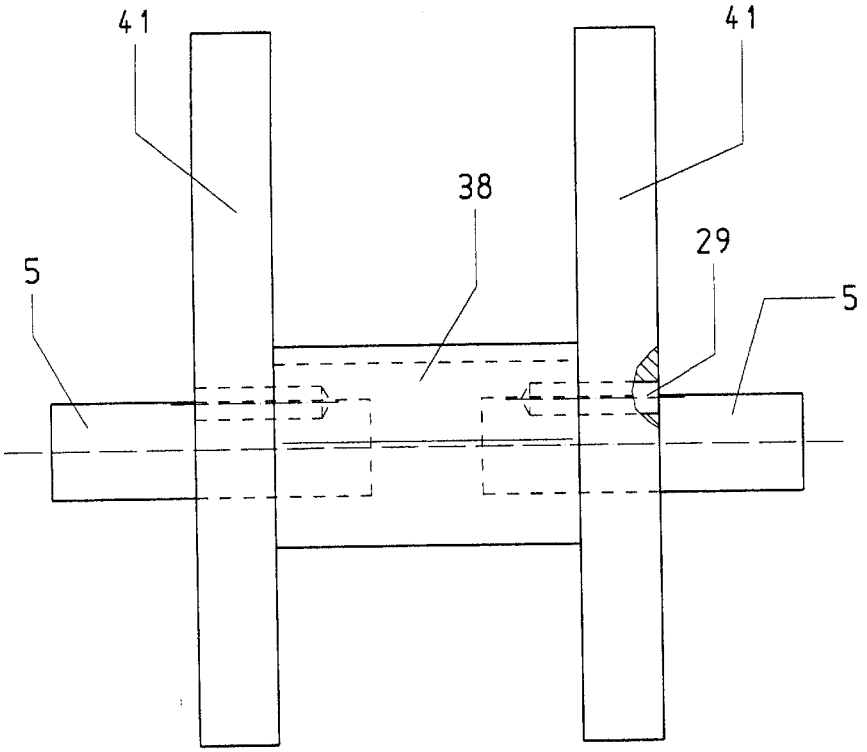
FIG. 68 is an enlarged side elevational view of a second configuration of a portion of a notching lever including a pair of notching wheels that can be used in conjunction with the notching apparatus.
Figure 70:
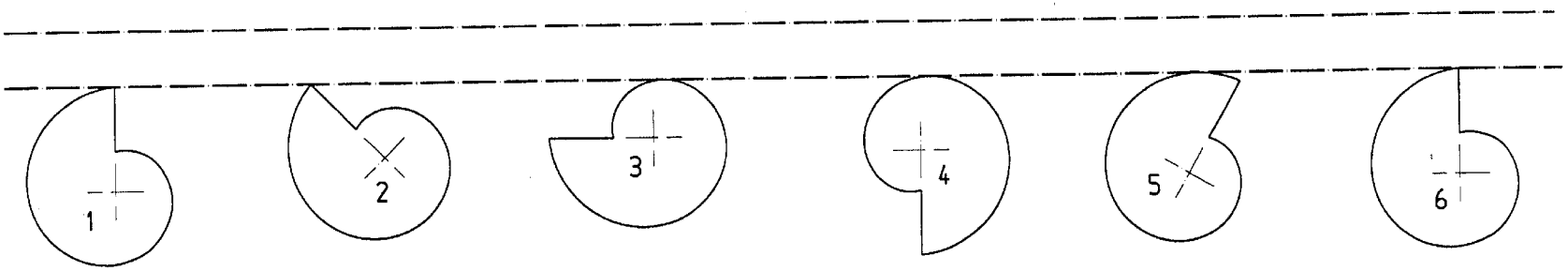
FIG. 70 is a front elevational view depicting rolling movement at various positions of one of the notching wheels engaged with a workpiece.

An independent and uncontrolled design shows in FIGS. 62–70 and particularly in FIGS. 68–70 a compressed air cylinder (17) sits under a notching lever (40) and presses one of the two notching wheels (41) beside the notching chisel (38) against the lower surface of the workpiece (3). The notching wheel (38) is taken along by friction and rotates so that its spiral formed circumference presses down the notching lever (40) and the drive cylinder or a spiral spring. This tension will be released and jumping and notching occurs when the highest point of the notching wheel (41) is passed by the workpiece (3) and the notching lever (40) can jump up by the step in the notching wheel.

Figure 72:
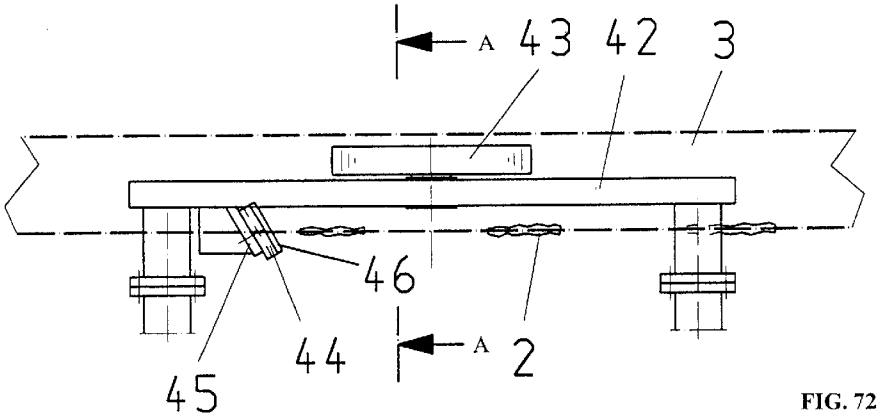
FIG. 72 is a front elevational view of the seventh embodiment.
Figure 71:
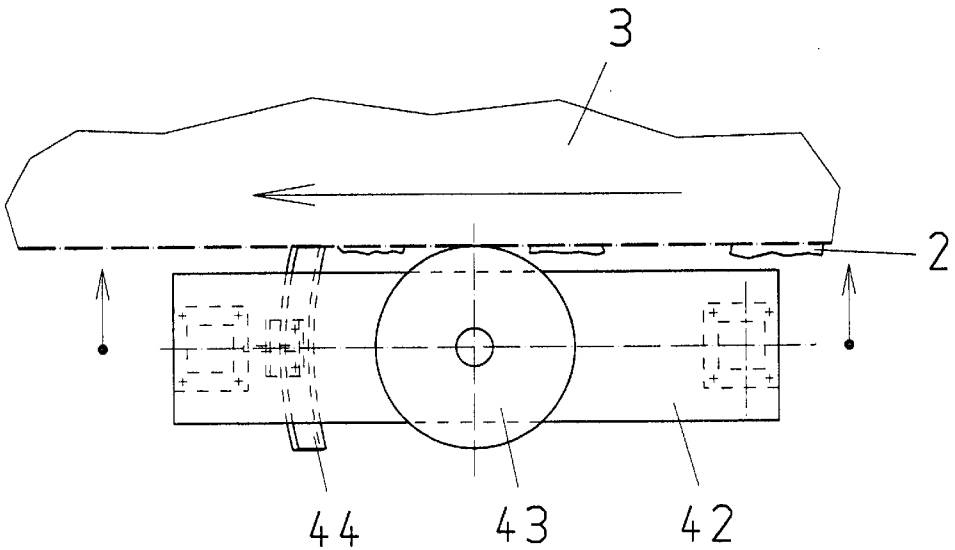
FIG. 71 is a top plan view of a seventh embodiment of a deburrer in accordance with the present invention.
Figure 73:
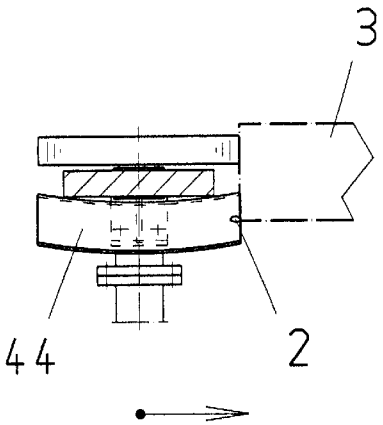
FIG. 73 is a sectional view as taken along line A—A of FIG. 72.

If the workpiece (3) consist of higher carbon content steel, it may occur that smaller rests of the cutting oxygen burr are still sticking to the base material. As shown in FIGS. 71–73 these little rests can be eliminated by a scratching plate (44) made of hardened spring steel, which is fixed with a clamping plate (46) and some screws on a holder (42) which as well carries a guiding wheel (43), the latter is pressed against the oxygen cut surface, i.e. if this device is installed on the deburring; machine for longitudinal deburring.

LEGEND

1–13 scarfing deburrer, —20 scarfing deburrer with drum segment, —28 scarfing deburrer for narrow workpieces, —30 scarfing deburrer with deburrer plate, —37 strand driven scarfing deburrer

1 deburrer drum or deburrer drum segment
2 oxygen cutting burr or oxygen cutting bead
3 workpiece (billet, bloom, slab, heavy plate)
4 scarfing blade, scarfing block or scarfing blade spiral
5 axle stub
6 shifting bearing
7 bearing support
8 bearing
9 drive
10 bellow cylinder
11 anti-rotation lever
12 roller table
13 locking piece
14 locking spring
15 deburrer lever or deburrer lever frame
16 rotation bearing
17 drive cylinder, knocking cylinder
18 support plate
19 lifting cylinder
20 lifting slide
21 lifting spring
22 pressure plate
23 holding plate
24 holding piece
25 protection panel
26 driving pinion
27 pushing/pulling rod
28 pushing rod guide
29 pin
30 deburrer plate
31 drive lever
32 drive roller
33 gear wheel
34 gear wheel pair
35 spring pulling element
36 bolt
37 pulling weight
38 notching chisel
39 anvil disks
40 notching lever

41 notching wheel
42 holder
43 guiding wheel
44 scratching plate
45 scratching block
46 clamping plate

What is claimed is:

1. A deburrer for removing a burr from a workpiece, comprising:

a support;

a mounting member movably disposed on the support;

at least a first spiral-shaped blade disposed on and protruding outwardly from the mounting member, the at least first spiral-shaped blade extending in a spiral fashion along the mounting member and being structured to deburringly engage the burr;

the at least first spiral-shaped blade including a plurality of spiral-shaped blade pieces substantially spirally aligned with one another;

in which the mounting member is formed with a spiral-shaped groove and includes a looking piece removably disposed in the groove, the plurality of spiral-shaped blade pieces being removably disposed in the groove: and the locking piece being engaged with an end of the at least first spiral-shaped blade to retain the plurality of spiral-shaped blade pieces in the groove.

2. The deburrer as set forth in claim 1, in which the mounting member is at least partially drum-shape and is angularly movable with respect to the support.

3. The deburrer as set forth in claim 1, which the at least first spiral-shaped blade is oriented at an angle of about 15° with respect to a central axis of the mounting member.

4. The deburrer as set fourth in claim 3, which the deburrer includes a motor operatively connected with the mounting member, the mounting member being rotatable about the central axis.

5. The deburrer as set forth in claim 4, in which the deburrer includes a biasing device that operatively extends between the at least first spiral-shaped blade and the mounting member.

6. The deburrer as set forth in claim 5, in which the biasing device is lifting spring.

7. A deburrer for removing a burr from a workpiece, the deburrer comprising:

a support;

a mounting member movably disposed on the support;

at least a first spiral-shaped blade disposed on and protruding outwardly from the mounting member, the at least first spiral-shaped blade extending in a spiral fashion along to mounting member and being structured to deburringly engage the burr, the at least first spiral-shaped blade including a plurality of spiral-shaped blade pieces substantially spirally aligned with one another, in which the mounting member is formed with a spiral-shaped groove and includes a locking piece removably disposed in the groove, the plurality of spiral-shaped blade pieces being removably disposed in the groove and being retained in the groove by the locking piece; and in which the locking piece includes a locking spring that retains the locking piece in the groove.

8. A deburrer for removing a burr from a workpiece, the deburrer comprising:

a support a mounting member movably disposed on the support;

at least a first spiral-shaped blade disposed on and protruding outwardly from the mounting member, the at least first spiral-shaped blade extending in a spiral fashion along the mounting member and being structured to deburringly engage the burr;

a second spiral-shaped blade disposed on and protruding outwardly from the mounting member the second spiral-shaped blade extending in a spiral fashion along the mounting member and being structured to deburringly engage the burr the at least first and second spiral-shaped blades extending in generally opposite spiral directions on the mounting member; and in which the deburrer includes at least a first lifting member, the mounting member being disposed on the at least first lifting member, the at least first lifting member being structured to lift the mounting member.

9. The deburrer as set forth in claim 8, wherein the at least first and spiral-shaped blades are spaced from one another.

10. The deburrer as set forth in claim 9, in which the at least first and second spiral-shaped blades extend in a spiral fashion non-parallel with one another.

11. The deburrer as set forth in claim 8, in which the at least first and second spiral-shaped blades each include a plurality of spiral-shaped blade pieces substantially spirally aligned with one another to form a substantially uninterrupted spiral-shaped cutting edge.

12. The deburrer of claim wherein the deburring blades are each locked in a groove on the mounting member.

13. The deburrer of claim wherein the deburring blades are bias with respect to the mounting member.

14. A deburrer for removing a burr from a workpiece, the deburrer comprising;

a support;

a mounting member movably disposed on the support; and at least a first spiral-shaped blade disposed on and protruding outwardly from the mounting member, the at least first spiral-shaped blade extending in a spiral fashion along the mounting member and being structured to deburringly engage the burn the deburrer including at least a first lifting member, the mounting member being disposed on the at least first lifting member, the at least first lifting member being structured to lift the mounting member; and in which the deburrer includes a reaction lever pivotably mounted on the support the at least first lifting member being mounted on the reaction lever.

15. A deburrer for removing a burr from a workpiece, the deburrer comprising:

a support;

a mounting member movably disposed on the support at least a first spiral-shaped blade disposed on and protruding outwardly from the mounting member, the at least first spiral-shaped blade extending in a spiral fashion along the mounting member and being structured to deburringly engage the burr, and in which the deburrer includes a reaction lever pivotably mounted on the support and a drive means operatively extending between the support and the reaction lever, the drive means being structured to pivot the reaction lever with respect to the support.

16. The deburrer as set forth in claim 15, which the drive means is an expandable member.

17. The deburrer as set forth in claim 15, in which the drive means includes a driving lever pivotably mounted on the support.

18. The deburrer as set forth in claim 17, in which the drive means includes a gear wheel pair operatively extending between the driving lever and the reaction lever.

* * * * *

UNITED STATES PATENT AND TRADEMARK OFFICE

CERTIFICATE OF CORRECTION

PATENT NO. : 6,725,515 B2
DATED : April 27, 2004
INVENTOR(S) : Horst Karl Lotz

It is certified that error appears in the above-identified patent and that said Letters Patent is hereby corrected as shown below:

Title page,
Item [74], *Attorney, Agent or Firm*, "Argarwal" should read -- Agarwal --.

Column 13,
Lines 8 and 9, after "workpiece", insert -- the deburrer --.
Line 21, "looking" should read -- locking --.
Line 30, "drum-shape" should read -- drum-shaped --.
Line 32, after "Claim 1," insert -- in --.
Line 35, "fourth" should read -- forth --.
Line 35, after "Claim 3," insert -- in --.
Line 55, "to" should read -- the --.

Signed and Sealed this

Eighteenth Day of January, 2005

JON W. DUDAS
*Director of the United States Patent and Trademark Office*